US007504924B2

(12) United States Patent
Inoue et al.

(10) Patent No.: US 7,504,924 B2
(45) Date of Patent: Mar. 17, 2009

(54) INDUCTIVE DEVICE AND METHOD FOR MANUFACTURING SAME

(75) Inventors: Tetsuo Inoue, Yokohama (JP); Takao Kusaka, Yokohama (JP); Taiju Yamada, Yokohama (JP)

(73) Assignees: Kabushiki Kaisha Toshiba, Tokyo (JP); Toshiba Materials Co., Ltd., Yokohama-shi (JP)

( * ) Notice: Subject to any disclaimer, the term of this patent is extended or adjusted under 35 U.S.C. 154(b) by 127 days.

(21) Appl. No.: 10/576,466

(22) PCT Filed: Oct. 25, 2004

(86) PCT No.: PCT/JP2004/015787

§ 371 (c)(1),
(2), (4) Date: Apr. 20, 2006

(87) PCT Pub. No.: WO2005/041224

PCT Pub. Date: May 6, 2005

(65) Prior Publication Data

US 2007/0040643 A1 Feb. 22, 2007

(30) Foreign Application Priority Data

Oct. 23, 2003 (JP) ..... 2003-363514

(51) Int. Cl.
*H01F 27/24* (2006.01)

(52) U.S. Cl. ..... 336/234

(58) Field of Classification Search ..... 336/65, 336/83, 200, 212, 233–234; 343/787–788
See application file for complete search history.

(56) References Cited

U.S. PATENT DOCUMENTS

| | | | | |
|---|---|---|---|---|
| 4,047,138 | A * | 9/1977 | Steigerwald | 336/100 |
| 2003/0117282 | A1 * | 6/2003 | Copeland et al. | 340/572.7 |

FOREIGN PATENT DOCUMENTS

| | | |
|---|---|---|
| JP | 5-090039 | 4/1993 |
| JP | 05-267922 | 10/1993 |
| JP | 07-221533 | 8/1995 |
| JP | 07-278763 | 10/1995 |
| JP | 11-176662 | 7/1999 |
| JP | 2002-204122 | 7/2002 |
| JP | 2003-110341 | 4/2003 |

* cited by examiner

*Primary Examiner*—Tuyen T. Nguyen
(74) *Attorney, Agent, or Firm*—Oblon, Spivak, McClelland, Maier & Neustadt, P.C.

(57) ABSTRACT

An inductance element (1) comprises a core (2) having a multilayer body (6) composed of magnetic alloy thin ribbons (5) and an insulating coating layer (7) which covers the peripheral surface of the multilayer body without being bonded thereto, and a coil (4) wound around the core (2). The magnetic alloy thin ribbons (5) are stacked in a non-adhered state or with a flexible insulating adhesive layer therebetween. Having such a structure, the inductance element can stably attain good characteristics even when it is small-sized or made short.

5 Claims, 15 Drawing Sheets

INDUCTIVE DEVICE AND METHOD FOR MANUFACTURING SAME

TECHNICAL FIELD

The present invention relates to an inductance element, which is used as an antenna element or the like of various types of equipment for transmitting a signal by a radio wave, and a method for manufacturing the same.

BACKGROUND ART

In recent years, a system for transmitting a signal by a radio wave between outside equipment and data carrier parts which are provided with an antenna element and a circuit element for storing data is being used in various fields. As data carrier parts, RF tag (signal frequency: 120 to 140 kHz (typically, 134.2 kHz)), a pen tag (signal frequency: 500 kHz) and non-contact IC card (signal frequency: 13.56-MHz band) are being put into practical use for management of various types of articles, physical distribution management, entering and leaving management, various types of tickets, a car-mounted keyless entry and immobilizer, various types of portable equipment such as portable telephones and the like.

And, a system of conducting the transmission of a signal with outside equipment by a radio wave is also used for the radio-controlled timepieces such as a wristwatch type radio-controlled timepiece, a stationary radio-controlled timepiece, and a car-mounted radio-controlled timepiece. Such a radio-controlled timepiece uses a signal carrier frequency of 40 to 120 kHz. For example, a signal carrier frequency of 40 kHz or 60 kHz is used in Japan and the United States, and a signal carrier frequency of 78 kHz is used in Europe. The radio-controlled timepiece is provided with an antenna element corresponding to such a signal carrier frequency.

For the antenna element of the data carrier parts, the radio-controlled timepieces and the like, an air-cored coil, or an inductive device (inductor) which combines a magnetic core and a coil is used. Among them, it is difficult to obtain inductance L and Q value (quality factor $Q=\omega \cdot L/R$ ($\omega$: angular frequency, L: inductance, R: resistance)) which are sufficiently used in a low frequency range of about a few hundred kHz or less by the air-cored coil. Therefore, the inductor element which has the magnetic core and the coil combined is mainly used for the antenna element which is used in a low frequency region (long-wave band).

Conventionally, it is general to use ferrite for the core of the antenna element, but the ferrite is brittle and has drawbacks that it is cracked if deformed only slightly and has a low magnetic permeability in terms of the magnetic characteristics. Therefore, the ferrite core cannot be used for the antenna element which is required to be thin and compact. Especially, the portable equipment is required to have shock resistance, so that its sufficient miniaturization cannot be achieved by using the ferrite which is easily cracked. The ferrite also has a disadvantage that a stable temperature characteristic cannot be obtained because it has a low Curie-point of about 200° C.

In connection with the circumstances described above, for example, Patent Documents 1 to 3 disclose that a multilayer body of amorphous magnetic alloy thin ribbons or nanocrystalline magnetic alloy thin ribbons is used for the magnetic core for antenna. But, the conventional antenna element, which is configured by winding a coil around the multilayer body (core) of the magnetic alloy thin ribbons, has not provided sufficient characteristics for compactness and high performance demanded to be achieved for the data carrier parts and radio-controlled timepieces.

For example, in a case where the antenna element is applied to portable equipment or the like, it is important that the antenna element is disposed within a limited space, so that it is sometimes necessary to dispose it in a bent state. But, for example, Patent Documents 2 and 3 cannot bend easily because the magnetic thin ribbons are mutually adhered with an insulating resin and the magnetic core has high rigidity. Even if the magnetic core can be bent, the characteristics of the magnetic alloy thin ribbons are degraded by a high stress produced when the magnetic core is bent. A magnetic core having a rectangular parallelepiped shape has a limited mounting style. Therefore, there are demands for a magnetic core of which characteristics are not degraded largely even if it is bent and an antenna element (inductor) using such a magnetic core.

To realize an essentially small and high-performance antenna element, it is important to further enhance the magnetic characteristics such as inductance L and Q value. The characteristics of the antenna element are influenced by not only the characteristics of the magnetic alloy thin ribbon but also its shape and size and the manufacturing conditions. But, an antenna element using a multilayer body (core) of existing magnetic alloy thin ribbons has not been studied enough about factors influencing on the characteristics when it is made compact and short. Therefore, characteristics (e.g., inductance L and Q value) conforming to the miniaturization and high performance which are demanded for the data carrier parts and radio-controlled timepieces have not been achieved.

Patent Document 3 discloses that induced magnetic anisotropy is provided to a magnetic alloy thin ribbon in its width direction. The magnetic alloy thin ribbon having the magnetic anisotropy provided in the width direction of the thin ribbon has characteristics (e.g., good Q value) which are demanded for an antenna element generally used in a relatively high frequency range, but the characteristics might become low depending on the used frequency region. Besides, Patent Document 3 discloses that magnetic alloy thin ribbons fabricated into a desired shape are stacked, and a heat treatment (heat treatment in a magnetic field) is performed while applying a magnetic field in the width direction of the thin ribbons, thereby providing induced magnetic anisotropy to the magnetic alloy thin ribbons in the width direction. But, when the width of the magnetic alloy thin ribbons is narrowed to realize the miniaturization of the antenna element, an influence of the demagnetizing field cannot be neglected, and there is a possibility that the characteristics of the antenna element are decreased.

Patent Document 1: Japanese Patent Laid-Open Application No. Hei 5-267922

Patent Document 2: Japanese Patent Laid-Open Application No. Hei 7-221533

Patent Document 3: Japanese Patent Laid-Open Application No. Hei 7-278763

SUMMARY OF THE INVENTION

The present invention has been made in view of the above circumstances and provides an inductance element which can be used to make, for example, data carrier parts, radio-controlled timepieces and the like thin, compact, short and the like, and a method for manufacturing the same.

A first inductance element according to the invention comprises a core provided with a multilayer body, which has plural magnetic alloy thin ribbons stacked in a non-adhered state, and an insulating coating layer which is formed of an insulator disposed to cover at least a part of the peripheral surface of the multilayer body in an on-adhered state and has flexibility, and a coil disposed around the core.

A second inductance element according to the invention comprises a core provided with a multilayer body which has plural magnetic alloy thin ribbons stacked with a flexible insulating adhesive layer therebetween, and a coil disposed around the core.

A third inductance element according to the invention comprises a core provided with a multilayer body which has plural magnetic alloy thin ribbons stacked with a cold-formed insulating interlayer therebetween, and a coil disposed around the core.

A fourth inductance element according to the invention comprises a core provided with a multilayer body which has plural magnetic alloy thin ribbons stacked, and a coil disposed around the core, wherein the multilayer body has a first magnetic alloy thin ribbon with a positive temperature dependency of inductance and a second magnetic alloy thin ribbon with a negative temperature dependency of inductance.

A fifth inductance element according to the invention comprises a core provided with a multilayer body which has plural magnetic alloy thin ribbons stacked, and a coil disposed around the core, wherein $a \leqq b-2$ [mm] is satisfied when it is determined that a length of the coil in its longitudinal direction is a [mm], and a length of the core corresponding to the longitudinal direction of the coil is b [mm].

A sixth inductance element according to the invention comprises a core provided with a multilayer body which has plural magnetic alloy thin ribbons stacked with an insulating interlayer therebetween, and a coil disposed around the core, wherein the magnetic alloy thin ribbons have ends in the width direction positioned on the inward side of the ends of the insulating interlayer.

A seventh inductance element according to the invention comprises a core provided with a multilayer body which has plural magnetic alloy thin ribbons stacked and magnetic alloy thin ribbons for ends which are disposed at both ends of the multilayer body to magnetically couple with the magnetic alloy thin ribbons, and a coil disposed around the core.

An eighth inductance element according to the invention comprises a solenoid shaped air core coil having a winding wire fixed by adhering, and a core which is provided with T-shaped magnetic alloy thin ribbons inserted into the air core coil from its both ends.

A ninth inductance element according to the invention comprises a core provided with a multilayer body of magnetic alloy thin ribbons to which induced magnetic anisotropy is provided in a longitudinal direction, and a coil disposed around the core, wherein it is used in a frequency range of 200 kHz or less.

A tenth inductance element according to the invention comprises a core provided with a multilayer body which has plural magnetic alloy thin ribbons stacked, and a coil disposed around the core, wherein the magnetic alloy thin ribbons are provided with induced magnetic anisotropy in a range of 70 to 85° with respect to their longitudinal directions.

An eleventh inductance element according to the invention comprises a core provided with a multilayer body which has plural magnetic alloy thin ribbons stacked, and a coil disposed around the core, wherein the magnetic alloy thin ribbons are determined to have a magnetic domain width m of 0.106 mm or less with respect to their longitudinal directions.

A twelfth inductance element according to the invention comprises a core which is provided with a multilayer body having plural magnetic alloy thin ribbons stacked and a coil disposed around the core, wherein when it is determined that a magnetic domain width of the magnetic alloy thin ribbons in a longitudinal direction is m, and a width of the magnetic alloy thin ribbons is w, a relationship of $m \leqq 0.106 \times (w/0.8)$ [mm] is satisfied.

A thirteenth inductance element according to the invention comprises plural prime inductors provided with a core which has a multilayer body with plural magnetic alloy thin ribbons stacked, and a coil disposed around the core, wherein the plural prime inductors are electrically connected in series and disposed to have a minimum distance of 3 mm or more between them.

A method of manufacturing an inductance element according to the invention comprises performing a heat treatment of wide magnetic alloy thin ribbons having a width larger than a desired core shape in a magnetic field to provide the wide magnetic alloy thin ribbons with magnetic anisotropy in the width direction; performing an insulating treatment on the surfaces of the wide magnetic alloy thin ribbons provided with the magnetic anisotropy; fabricating the wide magnetic alloy thin ribbons which are through the insulating treatment into a desired core shape and stacking to manufacture a core comprising a multilayer body of the magnetic alloy thin ribbons having the desired shape; and disposing a conductor around the core to form a coil.

MODE FOR IMPLEMENTING THE INVENTION

Figure 1:
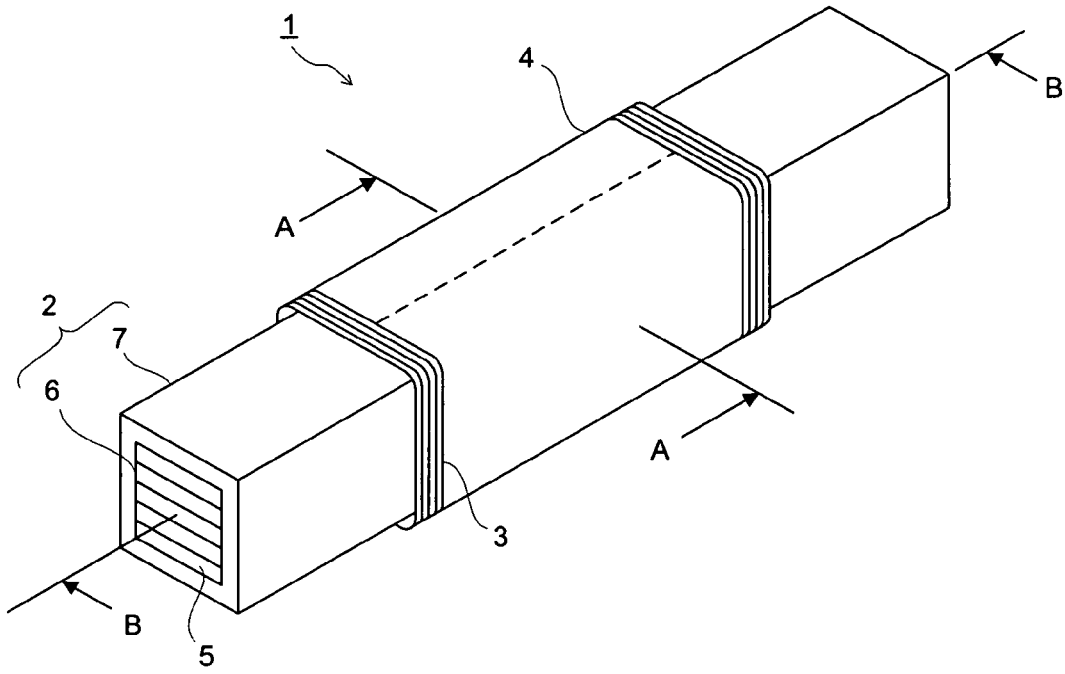
FIG. 1 is a perspective view showing an outline structure of an inductor according to a first embodiment of the invention.
Figure 2:
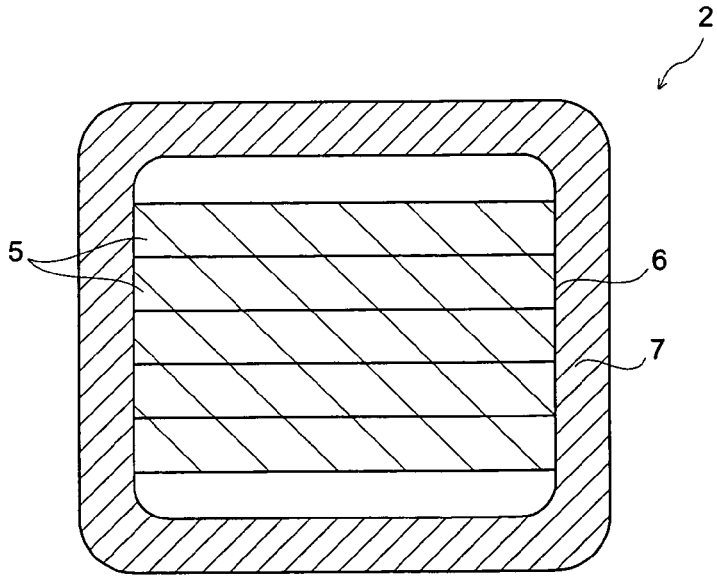
FIG. 2 is a sectional view showing a core portion of the inductor shown in FIG. 1.
Figure 3:
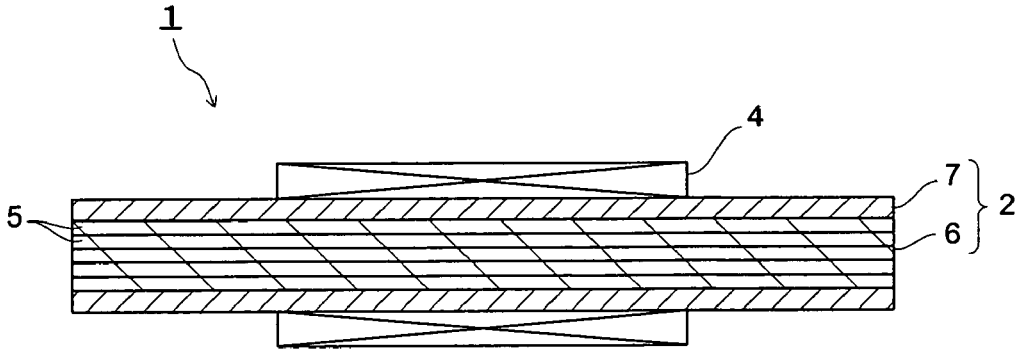
FIG. 3 is a longitudinal sectional view of the inductor show in FIG. 1.

Modes for carrying out the invention will be described. First, an inductance element (inductor) according to a first embodiment of the invention will be described with reference to FIG. 1 to FIG. 3. FIG. 1, FIG. 2 and FIG. 3 are diagrams showing an outline structure of the inductor according to the first embodiment. FIG. 1 is its perspective view, FIG. 2 is a transverse sectional view of a core portion of FIG. 1 taken along line A-A, and FIG. 3 is a longitudinal sectional view of the inductor shown in FIG. 1 taken along line B-B.

The inductor 1 shown in FIG. 1 to FIG. 3 is provided with a long core (magnetic core) 2 and a coil (solenoid coil) 4 which configured by disposing a coil conductor 3 around the core 2. For the coil conductor 3, a resin-coated copper wire or the like is used but not exclusive. The core 2 has a multilayer body 6 which is formed by stacking plural magnetic alloy thin ribbons 5 in a non-adhered state. Here, the non-adhered state is a state that when a force is applied, the individual magnetic alloy thin ribbons 5 can be deformed or slid by the force to change their relative positions.

Where the magnetic alloy thin ribbons are laminated by a method of applying a conventional adhesive agent, resin impregnating or the like, they are fixed to one another, so that the deformation and slip of the individual magnetic alloy thin ribbons are restricted by the adhesive agent or the deformation of the resin. The multilayer body 6 shown in FIG. 1 to FIG. 3 shows a state that the individually independent magnetic alloy thin ribbons 5 are stacked and covered with an insulating coating layer 7. The multilayer body 6 of the magnetic alloy thin ribbons 5 may be inserted into the insulating coating layer 7 having a hollow shape. FIG. 1 to FIG. 3 show the multilayer body 6 with the magnetic alloy thin ribbons 5 aligned, but the magnetic alloy thin ribbons 5 may be in a state inserted at random.

For the magnetic alloy thin ribbons 5 configuring the core 2, for example, amorphous magnetic alloy thin ribbons or microcrystalline magnetic alloy thin ribbons are used. The amorphous magnetic alloy thin ribbons have, for example, a composition substantially represented by the following general formula:

$$(T_{1-a}M_a)_{100-b}X_b \quad (1)$$

(where, T denotes at least one element selected from Co and Fe, M denotes at least one element selected from Ni, Mn, Cr, Ti, Zr, Hf, Mo, V, Nb, W, Ta, Cu, Ru, Rh, Pd, Os, Ir, Pt, Re and Sn, X denotes at least one element selected from B, Si, C and P, and a and b denote a value satisfying $0 \leqq a \leqq 0.3$, $10 \leqq b \leqq 35$ at %).

In the above formula (1), the element T should be adjusted its composition ratio depending on required magnetic characteristics such as a magnetic flux density, a magnetostrictive value, a core loss and the like. The element M is an element which is added to control thermal stability, corrosion resistance, and crystallization temperature. The added amount of the element M is preferably 0.3 or less as the value a. If the added amount of the element M is excessively large, the amount of the element T is decreased relatively, so that the magnetic characteristics of the amorphous magnetic alloy thin ribbons become low. The value a indicating the added amount of the element M is preferably 0.01 or more in view of practice. And, the value a is more preferably 0.15 or less.

The element X is an element essential to obtain an amorphous alloy. Especially, B is an element effective to provide a magnetic alloy in an amorphous state. Si is an element effective to assist the formation of an amorphous phase or to increase a crystallization temperature. If the content of the element X is excessively large, magnetic permeability is decreased or fragility is caused, and if it is excessively small, it is hard to obtain the amorphous state. Therefore, it is desirable that the content of the element X is in a range of 10 to 35 at %. It is more desirable that the content of the element X is in a range of 15 to 25 at %.

The microcrystalline magnetic alloy thin ribbons are formed of Fe-base alloy which has a composition substantially represented by the following general formula:

$$Fe_{100-c-d-e-f-g-h}A_cD_dE_eSi_fB_gZ_h \quad (2)$$

(where, A denotes at least one element selected from Cu and Au, D denotes at least one element selected from Ti, Zr, Hf, V, Nb, Ta, Cr, Mo, W, Ni, Co and rare earth element, E denotes at least one element selected from Mn, Al, Ga, Ge, In, Sn and platinum group elements, Z denotes at least one element selected from C, N and P, c, d, e, f, g and h denote a value satisfying $0.01 \leqq c \leqq 8$ at %, $0.01 \leqq d \leqq 10$ at %, $0 \leqq e \leqq 10$ at %, $10 \leqq f \leqq 25$ at %, $3 \leqq g \leqq 12$ at %, $15 \leqq f+g+h \leqq 35$ at %), and 20% or more in area ratio of the composition is microcrystalline particles having a particle diameter of 50 nm or less.

In the above formula (2), the element A is an element which enhances corrosion resistance, prevents crystal grains from becoming coarse, and improves magnetic characteristics such as a core loss, magnetic permeability and the like. If the content of the element A is too small, a sufficient effect of suppressing the crystal grains from becoming coarse cannot be obtained, and if its content is too large, the magnetic characteristics are degraded. Therefore, it is desirable that the content of the component A is in a range of 0.01 to 8 at %. The element D is an element which is effective to uniformize a crystal grain diameter and to decrease magnetostriction. It is desirable that the content of the element D is in a range of 0.01 to 10 at %.

The element E is an element which is effective to improve soft magnetic characteristics and corrosion resistance. It is desirable that the content of the component E is 10 at % or less. Si and B are elements which assist making an alloy amorphous at the time of producing the thin ribbons. It is desirable that the content of Si is in a range of 10 to 25 at %, and the content of B is in a range of 3 to 12 at %. Element Z may also be contained as an element for promoting formation of amorphous other than Si and B. In such a case, it is desirable that a total content of Si, B and the element Z is in a range of 15 to 35 at %. It is particularly desirable that the microcrystalline structure has crystal grains with a particle diameter of 5 to 30 nm, contained in the alloy in a range of 50 to 90% in area ratio.

The amorphous magnetic alloy thin ribbon which is used as the magnetic alloy thin ribbon 5 is produced by, for example, a liquid quenching method (molten metal quenching method). Specifically, it is produced by quenching an alloy material which is adjusted to a prescribed composition ratio from a melted state. The microcrystalline magnetic alloy thin ribbons can be obtained by, for example, a method of producing amorphous alloy thin ribbons according to the liquid quenching method, and performing a thermal treatment at a temperature in a range of −50 to +120° C. with respect to the crystallization temperature for one minute to five hours, to deposit microcrystalline particles. Otherwise, the microcrystalline magnetic alloy thin ribbons can also be obtained by a method of controlling the quenching rate of the liquid quenching method to directly deposit the microcrystalline particles.

The magnetic alloy thin ribbons 5 desirably has surface roughness Rf in a range of 0.08 to 0.45 in view of slip properties and the like between the thin ribbons when bent. Here, the surface roughness Rf is a value obtained by dividing average roughness Rz of ten roughnesses in a reference length of 2.5 mm specified in JIS-B-0601 by average thickness T obtained from the mass of the magnetic alloy thin ribbons 5. In other words, the surface roughness Rf is a value determined by a formula [Rf=Rz/T], which is used as a parameter to characterize the surface roughness.

If the surface roughness Rf of the magnetic alloy thin ribbons 5 is high, the slip between the thin ribbons becomes poor when they are bent to increase a stress, and the magnetic characteristics of the magnetic alloy thin ribbons 5 become low. And, if the smoothness of the surface becomes excessively high (the surface roughness Rf is excessively small), they are contacted closely and become hard to slip, and a stress becomes high, so that the magnetic characteristics of the magnetic alloy thin ribbons 5 become low. Therefore, the surface roughness Rf is desirably in a range of 0.08 to 0.45. The surface roughness Rf of the magnetic alloy thin ribbons 5 is more desirably in a range of 0.1 to 0.35.

The magnetic alloy thin ribbons 5, which are comprised of an amorphous magnetic alloy thin ribbon or a microcrystalline magnetic alloy thin ribbon, desirably have a thickness in a range of 5 to 50 μm. If the magnetic alloy thin ribbons 5 have a thickness of exceeding 50 μm, the magnetic permeability becomes low, and the characteristics of the inductor 1 might be degraded. Meanwhile, if the magnetic alloy thin ribbons 5 are determined to have a thickness of less than 5 μm, no more effects can be obtained, but the production cost becomes high. It is desirable that the magnetic alloy thin ribbons 5 have a thickness in a range of 5 to 35 μm, and more desirably in a range of 10 to 25 μm.

The shape of the magnetic alloy thin ribbons 5 should be determined appropriately according to the usage or shape of the inductor 1 or the required characteristics. Where ease of bending of the magnetic alloy thin ribbons 5 is considered, it is desirable to have a shape such that a ratio (w/t) of width w to thickness t is 10 or more, and a ratio (1/t) of length l to thickness t is 100 or more. It is also desirable that the magnetic alloy thin ribbons 5 are provided with magnetic anisotropy as described later. The direction of providing the magnetic anisotropy may be a width direction of the magnetic alloy thin ribbons 5, a direction with a prescribed angle from the width direction, or a longitudinal direction of the thin ribbons depending on the used frequency as described later in detail.

The magnetostrictive value of the amorphous magnetic alloy thin ribbons or the microcrystalline magnetic alloy thin ribbons can be decreased by optimizing the alloy compositions and performing an appropriate thermal treatment. It is desirable that a specific magnetostrictive value of the magnetic alloy thin ribbons 5 is $25 \times 10^{-6}$ or less as an absolute value. Magnetostriction of the magnetic alloy thin ribbons 5 is measured by the following strain gauge method. Specifically, for example, a strain gauge having a gauge line ($Ni_{57}Mn_{24}Cr_{16.5}Mo_{2.5}$ composition) is adhered to the surface of the magnetic alloy thin ribbons with, for example, nitrocellulose based, polyester based, phenol resin, araldite, polyester based adhesive agent after cleaning with a solvent such as acetone. When the length of the magnetic alloy thin ribbon in an external magnetic field applying direction is determined to be G in a Wheatstone bridge circuit, λs (=ΔG/G) which is obtained as ΔG/G from elongation ΔG which is obtained when magnetic saturation is caused in that direction is called a saturation magnetostriction.

An example of a relationship between a magnetostrictive value and inductance characteristic of the magnetic alloy thin ribbon 5 is shown in Table 1. Here, twenty amorphous magnetic alloy thin ribbons (alloy composition: $(Fe_{1-x}Co_x)_{78}(Si_8B_{14})_{22}$) having a width of 2 mm and a length of 30 mm were stacked. The obtained multilayer body was fixed with a heat shrinkable tube to form a core, on which a coil having an inner diameter of 3 mm and 100 turns is formed to produce an inductor. The inductor was bent by 5 mm, and a change in inductance characteristic was checked. The bent value (5 mm) indicates a linear distance between a straight line, which connects both ends of the core deformed into an arch shape, and the center of the core. The judged results of L characteristic in Table 1 are indicated as follows using as reference a value L at 100 kHz when the core is in a linear state: EXCELLENT when a change in value L measured in the bent state is within 10%, GOOD when it is within 30%, and NO GOOD when it exceeds 30%.

TABLE 1

| Sample No. | Value x of alloy composition | $\lvert\lambda s\rvert$ ($\times 10^{-6}$) | Judged result of characteristic L |
|---|---|---|---|
| 1 | 0 | 28 | NO GOOD |
| 2 | 0.2 | 25 | GOOD |
| 3 | 0.4 | 20 | GOOD |
| 4 | 0.6 | 18 | GOOD |
| 5 | 0.8 | 7 | EXCELLENT |
| 6 | 1 | 5 | EXCELLENT |

It is apparent from the judged results given in Table 1 that magnetostrictive value ($\lambda s$) of the magnetic alloy thin ribbon 2 is desirably $25\times10^{-6}$ or less in its absolute value. To obtain more stable characteristics, the magnetostrictive value ($\lambda s$) of the magnetic alloy thin ribbon 2 is desirably $10\times10^{-6}$ or less in its absolute value. And, the magnetic alloy thin ribbons 2 configuring the multilayer body 6 are not limited to the same magnetostrictive value ($\lambda s$). For example, the multilayer body 6 may be configured by alternately stacking magnetic alloy thin ribbons having positive magnetostriction and magnetic alloy thin ribbons having negative magnetostriction.

In addition, it is also effective to alternately stack magnetic alloy thin ribbons having positive temperature dependency of inductance and magnetic alloy thin ribbons having negative temperature dependency inductance. According to such an inductor, deviation of a resonance frequency with respect to a temperature change can be suppressed. Specifically, it is possible to determine a change rate of inductance under a practical environment of −20 to 60° C. to ±1% or less, and desirably ±0.1% or less. For example, where the inductor 1 is used as a long-wave band receiving antenna, it is desirable to determine so that temperature gradient of the inductance at 40 kHz becomes positive or negative.

The deviation of resonance frequency of the inductor 1 influences greatly on the receivability of a signal. Therefore, a decrease or the like of the receiving sensitivity of the antenna element due to, for example, a change in environmental temperature can be prevented by suppressing the deviation of resonance frequency of the inductor 1. And, the resonance frequency is basically proportional to $1/(LC)^{1/2}$, so that it is also effective to use an inductor having positive or negative of a temperature change rate and a capacitor having a reversed temperature change rate in combination. The inductor generally has a positive temperature change rate, so that it is effective to use in combination with a capacitor having a negative temperature change rate.

The magnetic alloy thin ribbons 5 are stacked in a non-adhered state with an unshown insulating interlayer intervened. For the insulating interlayer, various types of known insulators such as a surface oxide film, an insulating oxide coating, a powder-adhered layer, an insulating resin coating on the magnetic alloy thin ribbons 5 can be used. But, an insulator not having adhesiveness is used so that the interlayers of the magnetic alloy thin ribbons 5 are not adhered for fixing. The multilayer body 6 which has the plural magnetic alloy thin ribbons 5 stacked in a non-adhered state is covered with the insulating coating layer 7 which is formed of a flexible insulator so to keep its stacked state. The insulating coating layer 7 is disposed to cover at least a part of the peripheral surface of the multilayer body 6 in a non-adhered state. If the multilayer body 6 and the insulating coating layer 7 are adhered, the deformation and slipping of the magnetic alloy thin ribbons 5 are restricted when the multilayer body 6 is bent.

A flexible insulator is used as a component material for the insulating coating layer 7. But, if it is merely expandable largely, there is a possibility that it is broken by rubbing, a pressure and the like at the time of winding the coil conductor 3. When the insulating coating layer 7 is broken, a short circuit occurs in the magnetic alloy thin ribbons 5, and the characteristics of the inductor 1 are lowered. Therefore, it is desirable to use an insulating material, which has hardness, abrasion resistance and the like resistant to the winding work in addition to the flexibility, for the insulating coating layer 7. Examples of such an insulating material are silicone rubber based, fluororubber based, and butadiene rubber based insulating rubber materials, and silicone based, polyethylene based, polypropylene based, polyester based, polyamide based, fluororesin based, and polyacetal resin based insulating resin materials.

Especially, in order to deform flexibly, it is desirable that the insulating coating layer 7 has an elongation percentage of 10% or more. Besides, it is desirable to use a material having shore hardness of 20 or more as hardness to resist the winding work. It is desirable that the thickness of the insulating coating layer 7 is made thin in a range not deteriorating its failure strength or the like. The insulating coating layer 7 can be prevented from being broken by increasing its thickness, but a possibility of restricting its elongation, and the deformation, slipping or the like of the magnetic alloy thin ribbons 5 becomes high. It is desirable that the above-described insulating coating layer 7 formed of the insulating material has a thickness of 1 mm or less.

The state that the peripheral surface of the multilayer body 6 of the magnetic alloy thin ribbons 5 is covered with the non-adhesive insulating coating layer 7 can be obtained by inserting the multilayer body 6 of the magnetic alloy thin ribbons 5 into a tube formed of, for example, insulating rubber or insulating resin. And, the multilayer body 6 of the magnetic alloy thin ribbons 5 may be covered with a sheet formed of insulating rubber or insulating resin, and only the ends of the sheet may be adhered. The tube formed of insulating rubber or insulating resin is effective as the insulating coating layer 7 of the miniaturized multilayer body 6. The insulating coating layer 7 is adequate when it covers at least a part of the multilayer body 6 on which the coil conductor 3 is wound.

To prevent a handling property from lowering while keeping the stacked state of the magnetic alloy thin ribbons 5, the periphery of the multilayer body 6 is entirely covered with the insulating coating layer 7. Besides, it is also possible to obtain a curved core by deforming the multilayer body 6 in a non-adhered state into a prescribed shape, and partly fixing with an adhesive agent or impregnating with resin, putting in an insulating holder or solidifying the interlayer insulator. Even when a method of partly fixing the multilayer body 6 with the adhesive resin, band or the like in order to improve assembling property and stabilization of shape, the effects of the invention can be obtained if the magnetic alloy thin ribbons 5 are mostly free.

The space within the insulating coating layer 7 is preferably filled with the multilayer body 6 in order to enhance the characteristics of the inductance L and the like. But, if the space factor of the multilayer body 6 to the inside space of the insulating coating layer 7 is excessively large, bendability or the like of the core 2 becomes low. Therefore, it is desirable that a space for free deformation of the multilayer body 6 of the magnetic alloy thin ribbons 5 is reserved within the insulating coating layer 7. Specifically, it is desirable that the space factor of the multilayer body 6 to the inside space (e.g., the inner volume of tube) of the insulating coating layer 7 is 90% or less, and more desirably 80% or less.

It is desirable that the space factor of the multilayer body 6 is 30% or more because the characteristics of the inductor 1 become low if the space factor of the multilayer body 6 is excessively small. As a method of lowering the space factor of the multilayer body 6, it is also effective to configure the multilayer body 6 by stacking, for example, the magnetic alloy thin ribbons 5 each having a different width. The space factor indicates a relative value when a cross-section space factor having the multilayer body 6 filled most densely into the inside space of the insulating coating layer 7 is determined 100.

Thus, the multilayer body 6 of the magnetic alloy thin ribbons 5 configuring the core 2 is disposed in a free state within the insulating coating layer 7, and the insulating coating layer 7 itself is flexible, so that the core 2 can be bent (e.g., curved) easily. Then, the magnetic alloy thin ribbons 5 in the bent state can be prevented from the occurrence of unwanted distortion or stress. Accordingly, it is possible to suppress the original characteristics (inductance L, Q value and the like) of the inductor 1 from lowering even when the inductor 1 is disposed within a limited space. In other words, various types of equipment in which the inductor 1 is mounted can be made compact and high performance.

Figure 4:
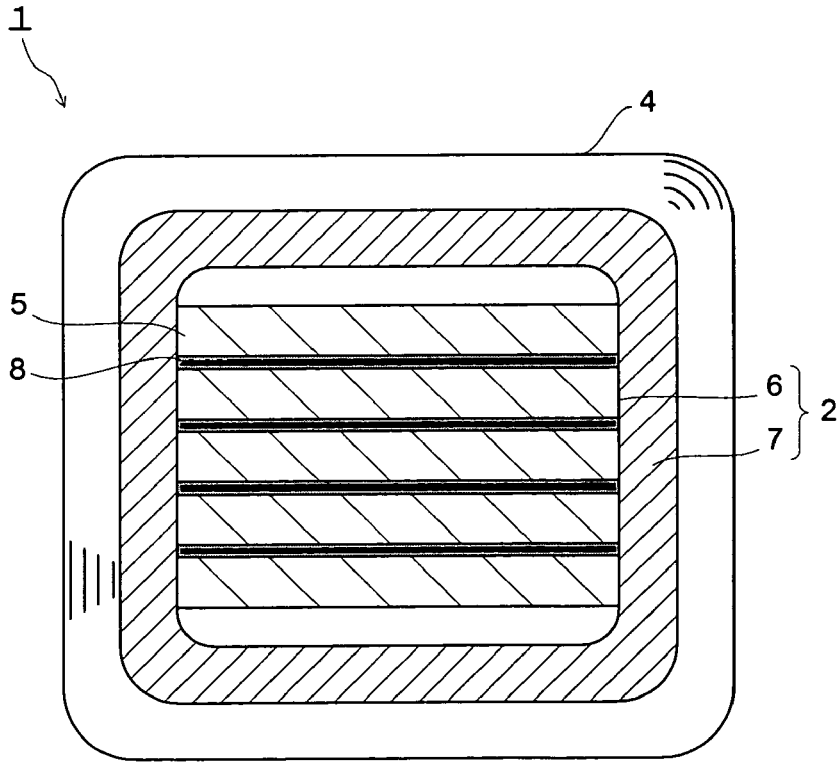
FIG. 4 is a transverse sectional view showing a modified example of the inductor shown in FIG. 1.

The inductor 1 shown in FIG. 1 to FIG. 3 has the multilayer body 6 which has the plural magnetic alloy thin ribbons 5 stacked in a non-adhered state. Meanwhile, the inductor 1 shown in FIG. 4 has the multilayer body 6 which has the plural magnetic alloy thin ribbons 5 stacked via the flexible insulating adhesive layer 8. FIG. 4 is a transverse sectional view showing a modified example of the inductor 1. Even the multilayer body 6 having the flexible insulating adhesive layer 8 can enhance the bendability of the core 2, and it becomes possible to suppress the occurrence of distortion or stress in the magnetic alloy thin ribbons 5 in the bent state.

Thus, property degradation when disposed in the bent state can also be suppressed by the inductor 1 which has the flexible insulating adhesive layer 8 applied to the interlayer insulation between the magnetic alloy thin ribbons 5. Accordingly, it becomes possible to conform to the provision of compact and high-performance various types of equipment in which the inductor 1 is mounted. The inductor 1 shown in FIG. 4 has the same structure as that of the inductor 1 shown in FIG. 1 through FIG. 3 except that the multilayer body 6 which has the plural magnetic alloy thin ribbons 5 stacked via the flexible insulating adhesive layer 8 is used. Especially, it is desirable that the space factor of the multilayer body 6 to the inside space of the insulating coating layer 7 is 30% or more and 90% or less.

It is important that the flexible insulating adhesive layer 8 in the inductor 1 shown in FIG. 4 has good deformability and high electrical isolation than a bonding strength. If the electrical isolation of the adhesive layer 8 is low, there is a possibility that the magnetic alloy thin ribbons 5 contact to one another to increase eddy current. For the insulating adhesive layer 8, it is desirable to use, for example, an elastomer based adhesive agent such as chloroprene rubber based, nitrile rubber based, polysulphide based, butadiene rubber based, SRB based or silicone rubber based, a resin based adhesive agent mainly formed of thermoplastic resin such as vinyl acetate based, polyvinyl alcohol based, polyvinyl acetal based, vinyl chloride based, polystyrene based or polyimide based, or an adhesive agent formed of a mixture of them.

The flexible insulating adhesive layer 8 preferably has a thickness of 0.1 mm or less so that its elongation and the deformation of the magnetic alloy thin ribbons 5 are not disturbed. Besides, it is desirable to use an insulating adhesive agent having an elongation percentage of 10% or more in order to flexibly deform the multilayer body 6. And, it is desirable to use an insulating adhesive agent having an withstand voltage of 500 V/mm or more in order to secure good insulating properties among the magnetic alloy thin ribbons 5.

It is also effective to apply a material which can be cold-formed, to the insulating interlayer of the magnetic alloy thin ribbons 5. The insulating interlayer which can be cold-formed is a material which can be formed at a temperature of 200° C. or less. For the insulating interlayer, a resin material which is treated with, for example, an oily pigment or at a low temperature can be used. The resin material treated at a low temperature may be a resin which is not cured completely. The adhesion among the magnetic alloy thin ribbons 5 is lowered by the insulating interlayer which can be cold-formed, so that a stress generated in the multilayer body 6 can be lowered.

In a case where the insulating interlayer is applied, it is desirable to form the multilayer body 6 by using the magnetic alloy thin ribbons 5 formed of a Co base amorphous magnetic alloy. The Co base amorphous magnetic alloy thin ribbons have high magnetic permeability, so that the number of winding of the inductor 1 can be decreased and the coil's resistance value can be decreased. The Co base amorphous magnetic alloy thin ribbons have a high Q value particularly at 40 kHz, and the receiving sensitivity of the antenna element can be enhanced.

The inductor 1 of the above-described embodiment is used as a magnetic sensor or the like, such as an antenna element or a direction sensor. Especially, the inductor 1 is suitable for data carrier parts such as RF tag having a signal carrier frequency of 120 to 140 kHz or a pen tag having a signal carrier frequency of about 500 kHz, and an antenna element of a radio-controlled timepiece having a signal carrier frequency of 40 to 120 kHz. The application of the inductor 1 to data carrier parts having a signal carrier frequency of 500 kHz or less or an antenna element of a radio-controlled timepiece enables to provide the data carrier parts or the radio-controlled timepiece with miniaturization and high performance.

Thus, the inductor 1 is effective to make equipment, in which it is mounted, compact and thin. Therefore, it is suitably used for portable equipment. The data carrier parts are provided with, for example, the inductor 1 as an antenna element and circuit parts (e.g., IC chip) including an information storing element and other circuits. A signal is transmitted by a radio wave between the data carrier parts and outside equipment (a reader-writer, etc.). And, the radio-controlled timepiece is provided with the inductor 1 as an antenna element.

Figure 5:
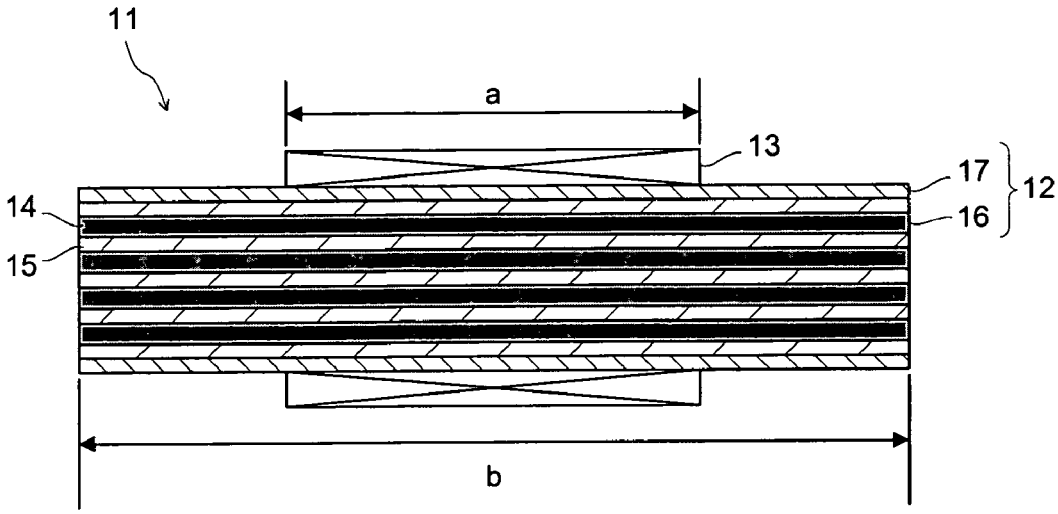
FIG. 5 is a longitudinal sectional view showing an outline structure of an inductor according to a second embodiment of the invention.

An inductance element (inductor) according to a second embodiment of the invention will be described with reference to FIG. 5 through FIG. 8. FIG. 5 is a longitudinal sectional view showing an outline structure of the inductor according to the second embodiment of the invention. An inductor 11 shown in the above figures is provided with a long core (magnetic core) 12 and a coil (solenoid coil) 13 which is configured by winding a coil conductor around the core 12 by a prescribed number of turns in the same manner as in the above-described first embodiment. The core 12 has a multilayer body 16 which has plural magnetic alloy thin ribbons 14 stacked with an insulating interlayer 15 intervened, and an insulating coating layer 17 which fixes or holds the multilayer body 16 by covering its peripheral surface or the like.

For the insulating interlayer 15 disposed between the magnetic alloy thin ribbons 14, various types of known insulators, such as an insulating resin coating, a surface oxide film of the magnetic alloy thin ribbon 14, an insulating oxide coating and a powder-adhered layer, can be used. The insulating interlayer 15 may be one which keeps a non-adhered state between the magnetic alloy thin ribbons 14 or which also serves as the adhesive layer between the magnetic alloy thin ribbons 14 in the same manner as in the above-described first embodiment. It is desirable that the magnetic alloy thin ribbons 14 have the same structure as that in the above-described first embodiment, for example, the same alloy composition, magnetostrictive value, thickness, shape and the like. And, the insulating coating layer 17 may be formed of an insulating resin tube in the same manner as in the above-described first embodiment or general resin impregnation may be applied.

In the inductor shown in FIG. 5, when it is assumed that a length of the coil 13 in a longitudinal direction (an axial direction of the solenoid coil configured by winding the coil conductor) is a [mm], and a length (a length in the longitudinal direction of the magnetic alloy thin ribbon 14) of the core 12 in the longitudinal direction of the coil is b [mm], the coil length a satisfies a relationship of $a \leqq b-2$ [mm] with respect to the core length b. Inductance L can be improved by satisfying the relationship between the coil length a and the core length b. In other words, when the relationship of $a \leqq b-2$ [mm] is satisfied, a magnetic flux, which passes in the longitudinal direction of the magnetic alloy thin ribbons 14, effectively interlinks the coil 13, so that the inductance L is improved.

For example, in a case where the coil length a and the core length b are similar to each other, a magnetic flux which does not act effectively on the inductance L, namely a magnetic flux which leaks from the side of the coil 13, increases, so that the inductance L lowers. Meanwhile, the core length b is made longer than the coil length a at either end by 1 mm or more ($a+2 \leqq b$), so that the sufficient inductance L can be obtained depending on the core length b. In other words, a dependence property of the inductance L on the coil length a is decreased, and it becomes possible to stably obtain good inductance L.

Specifically, by satisfying the relationship of $a \leqq b-2$ [mm], practical inductance (e.g., inductance of 60% or more) can be secured with respect to the maximum inductance which can be obtained by the core length b. In other words, when the coil length a becomes $a>b-2$ [mm] with respect to the core length b, the inductance decreases sharply. It is more desirable that the relationship between the coil length a and the core length b satisfies $a \leqq b-4$ [mm]. Thus, the inductance can be improved more stably.

The inductance is improved by making the coil length b long with respect to the core length a, but if the core length b is excessively long, no further effect can be obtained, and there is a possibility that the miniaturization of the inductor 1 is inhibited. In practice, the core length b is desired to satisfy the relationship of $b \leqq a+30$ [mm] with respect to the coil length a. Similarly, the inductance is improved by making the coil length a shorter, but it is difficult to obtain the necessary number of turns if the coil length a is excessively short. In practice, the coil length a is preferably 1 mm or more.

The above-described relationship between the coil length a and the core length b also acts effectively on the inductor 1 of the first embodiment described above. Therefore, it is also desirable that the core 2 and the coil 4 have the same relationship in the inductor 1 of the first embodiment.

Figure 6:
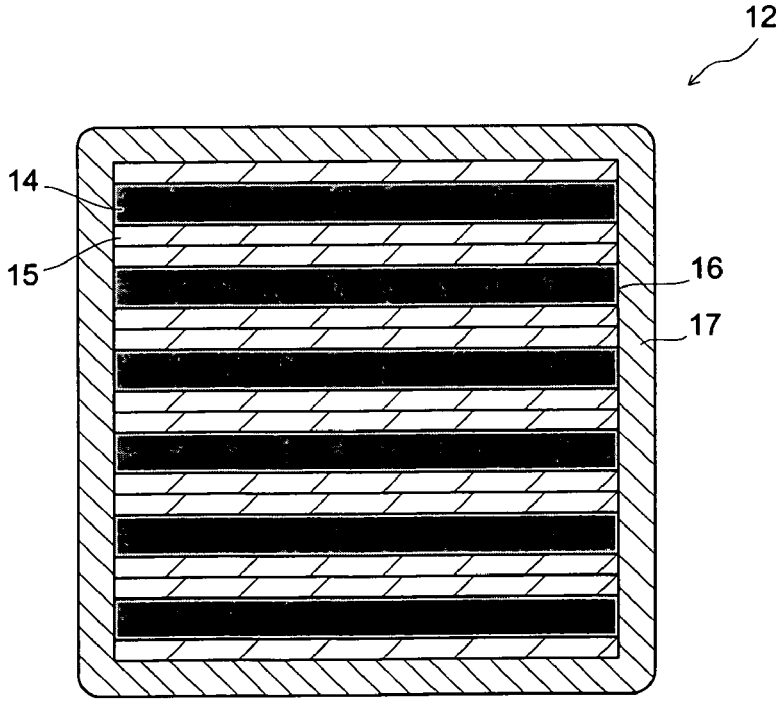
FIG. 6 is a transverse sectional view showing an example of a core portion of the inductor shown in FIG. 5.
Figure 7:
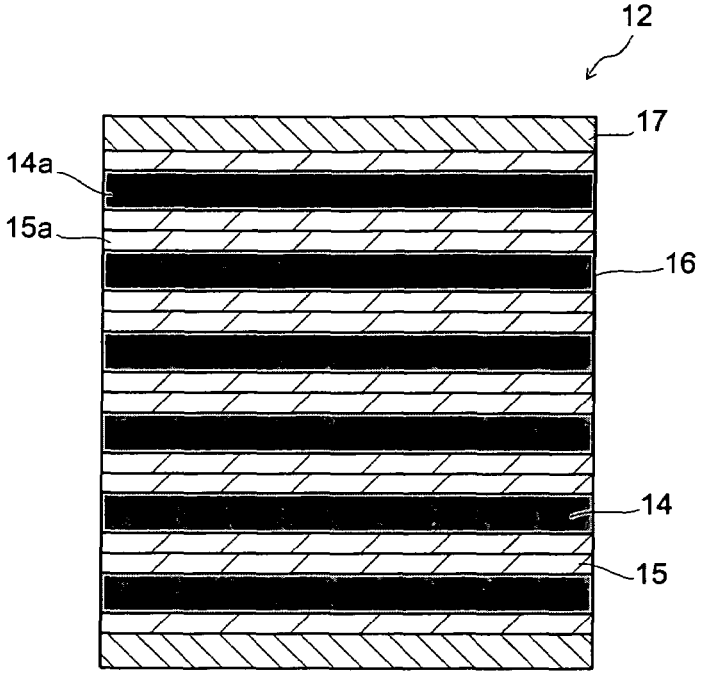
FIG. 7 is a transverse sectional view showing another example of the core portion of the inductor shown in FIG. 5.
Figure 8:
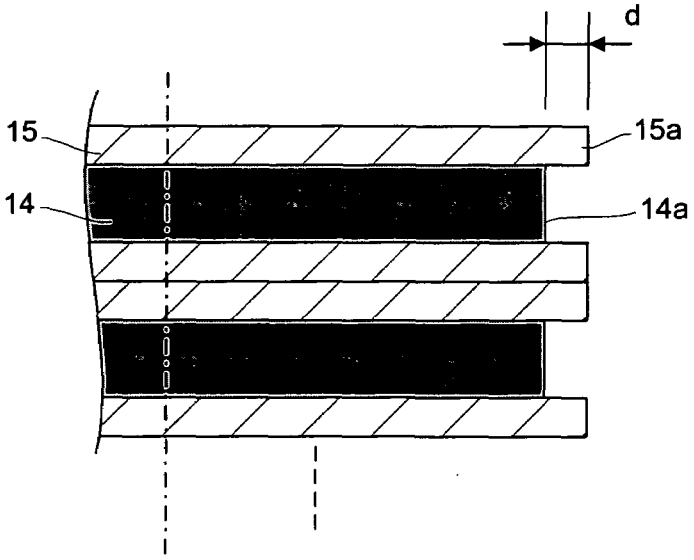
FIG. 8 is a sectional view showing a main portion of the core portion of the inductor shown in FIG. 5.

The shape of the core 12 in the inductor 11 of the second embodiment will be described in detail. For example, where an insulating tube (including a heat shrinkable tube and the like), resin impregnation or the like is used, the entire peripheral surface of the multilayer body 16 of the magnetic alloy thin ribbons 14 is covered with the insulating coating layer 17 as shown in FIG. 6. And, the side of the multilayer body 16 of the magnetic alloy thin ribbons 14 might be exposed as shown in FIG. 7 depending on the production process of the core 12. Where the ends of the magnetic alloy thin ribbons 14 configuring the multilayer body 16 are not covered with the insulating interlayer 15, ends 14*a* of the magnetic alloy thin ribbons 14 in their width direction are preferably positioned on the inward side of ends 15*a* of the insulating interlayer 15 as shown in FIG. 8.

The application of the above-described structure enables to suppress a short circuit from occurring between the ends 14*a* of the magnetic alloy thin ribbons 14 when the coil conductor is wound around the multilayer body 16 of the magnetic alloy thin ribbons 14. Thus, it becomes possible to stably obtain the inductor 11 excelling in the characteristics. A distance d from the ends 15*a* of the insulating interlayers 15 to the ends 14*a* of the magnetic alloy thin ribbons 14 in the width direction, in other words, a distance d that the ends 14*a* of the magnetic alloy thin ribbons 14 in the width direction has retreated from the ends 15*a* of the insulating interlayers 15 is preferably 0.001 mm or more.

If a preset value of the distance d is less than 0.001 mm, a short circuit is easily caused between the ends 14*a* of the magnetic alloy thin ribbons 14 because of a slight failure. It is desirable that the distance d is 0.01 mm or more. But, if the distance d is too large, the volume of the magnetic alloy thin ribbons 14 decreases, and the magnetic characteristics become low, so that the distance d is preferably 0.4 mm or less, and more preferably 0.1 mm or less. The structure in that the ends 14*a* of the magnetic alloy thin ribbons 14 in the width direction are retreated inward from the ends 15*a* of the insulating interlayers 15 can be obtained by light etching the magnetic alloy thin ribbons 14 or its multilayer body 16 as shown in, for example, a production process described later.

Figure 9:
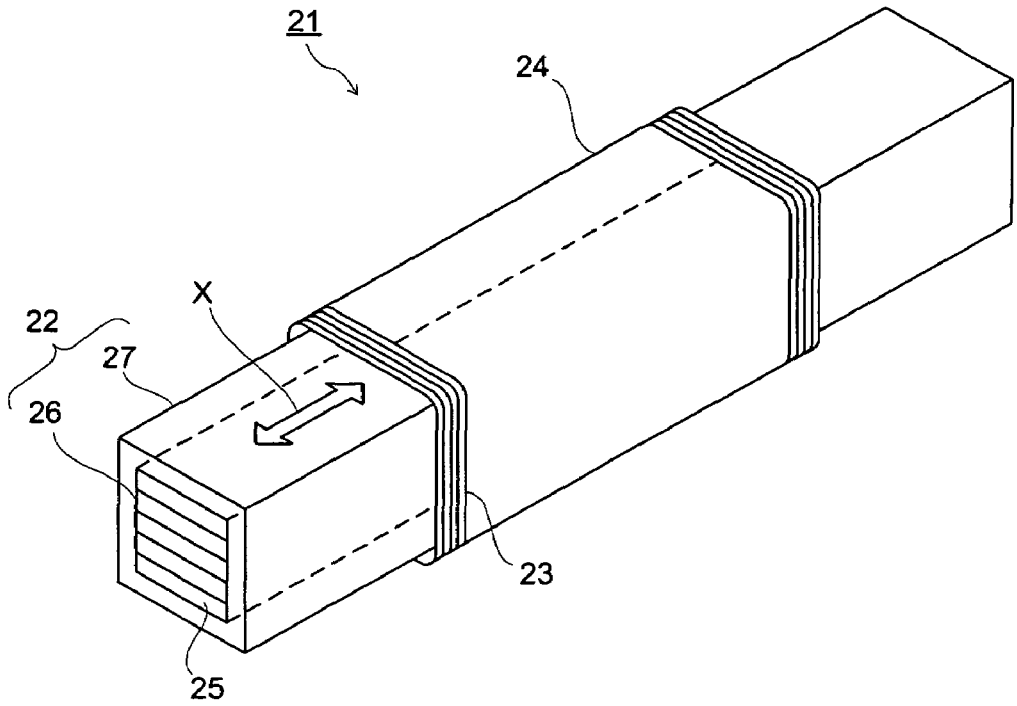
FIG. 9 is a perspective view showing an outline structure of an inductor according to a third embodiment of the invention.

The inductance element according to a third embodiment of the invention will be described with reference to FIG. 9. An inductor 21 shown in FIG. 9 is provided with a long core (magnetic core) 22 and a coil (solenoid coil) 24 which is configured by winding a coil conductor 23 around the core 22 by a prescribed number of turns in the same manner as in the above-described first and second embodiments. The core 22 has a multilayer body 26 which has plural magnetic alloy thin ribbons 25 stacked via unshown insulating interlayer, and an insulating coating layer 27 which fixes or holds by covering the peripheral surface of the multilayer body 26.

In the inductor 21 of the third embodiment, magnetic anisotropy is provided in the longitudinal direction of the magnetic alloy thin ribbons 25 which configure the core 22 as indicated by arrow X in the figure. It is desirable that the other structure is same as in the first or second embodiment. The inductor 21 is used in a frequency range of 200 kHz or less. The inductor 21 using the magnetic alloy thin ribbons 25, to which the magnetic anisotropy is provided in the longitudinal direction, is poor in the inductance characteristic in a frequency range of exceeding 200 kHz, but the inductance L becomes high by lowering the frequency range, and a practicable inductance L can be obtained in a frequency range of 100 kHz or less.

Figure 10:
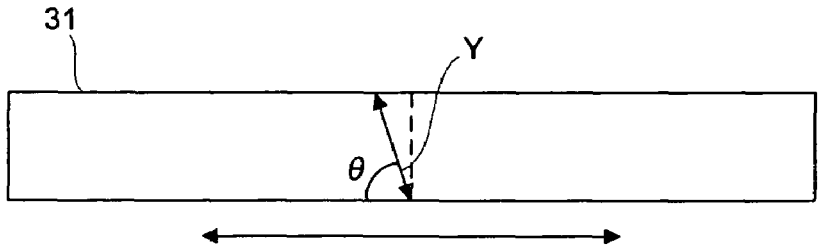
FIG. 10 is a plan view showing a magnetic alloy thin ribbon used for an inductor according to a fourth embodiment of the invention.

An inductance element according to a fourth embodiment of the invention will be described. The inductor of this embodiment is provided with a long core (magnetic core) and a coil (solenoid coil) which is configured by winding the coil conductor around the core by a prescribed number of turns in the same way as in the above-described embodiment. The core has a multilayer body, which has plural magnetic alloy thin ribbons stacked via an insulating interlayer, and an insulating coating layer which fixes or holds by covering the peripheral surface of the multilayer body. In the inductor of this embodiment, magnetic anisotropy is applied to in an oblique direction with respect to the width direction of magnetic alloy thin ribbons 31 as shown in FIG. 10. It is desirable that the other structure is same as in the first or second embodiment.

The magnetic anisotropy providing direction of the magnetic alloy thin ribbons 31 (indicated by arrow Y in the figure) is determined so that angle θ to the longitudinal direction of the magnetic alloy thin ribbons 31 is in a range of 70 to 85°. The longitudinal direction of the magnetic alloy thin ribbons 31 indicates a normal direction of the winding wire winding surface. The magnetic anisotropy is controlled by the direction of a magnetic field when the magnetic alloy thin ribbons 31 are undergone a heat treatment in a magnetic field. Thus, the Q value of the inductor can be enhanced by using the magnetic alloy thin ribbons 31 to which the magnetic anisotropy was applied in an oblique direction with respect to its width direction. Therefore, when the inductor is used as an antenna element, it becomes possible to improve a signal receiving sensitivity.

Besides, the Q value of the inductor is also affected by a magnetic domain width of the magnetic alloy thin ribbons 31. In other words, where induced magnetic anisotropy is applied to the magnetic alloy thin ribbons 31 in the in-plane width direction, the Q value of the inductor can be increased by narrowing a magnetic domain width with respect to the longitudinal direction of the thin ribbons (a normal direction of the winding wire winding surface). It is desirable that the magnetic domain width m with respect to the longitudinal direction of the thin ribbons is specifically 0.106 mm or less. Here, the magnetic domain width m indicates a reciprocal number of the number of magnetic domains disposed for a unit length in the normal direction of the winding wire winding surface in a direction perpendicular to the direction of an axis of easy magnetization.

By satisfying the above conditions ($m \leqq 0.106$ mm), the Q value of the inductor can be enhanced. Therefore, where the inductor is used as an antenna element, it becomes possible to enhance the signal receiving sensitivity and the like. And, the magnetic domain width m has different effects depending on the sizes because of a demagnetizing field due to the shape of the thin ribbons. Therefore, when the magnetic alloy thin ribbons 31 has a thickness t small enough with respect to the width w, it is desirable that the condition $m \leqq 0.106 \times (w/0.8)$ [mm] is satisfied.

The inductors of the above-described second through fourth embodiments are also used as a magnetic sensor or the like such as an antenna element or a direction sensor in the same manner as in the first embodiment. The inductors according to the second and fourth embodiments are suitable as data carrier parts such as an RF tag having a signal carrier frequency of 120 to 140 kHz or a pen tag having a signal carrier frequency of about 500 kHz, or an antenna element for a radio-controlled timepiece having a signal carrier frequency of 40 to 120 kHz. The inductor according to the third embodiment is suitable for an RF tag having a signal carrier frequency of 120 to 140 kHz or an antenna element for a radio-controlled timepiece having a signal carrier frequency of 40 to 120 kHz. These inductors are applied to the data carrier parts or the antenna element of a radio-controlled timepiece, so that such equipment can be made compact and high performance. The inductor is suitably used for portable equipment.

Figure 11:
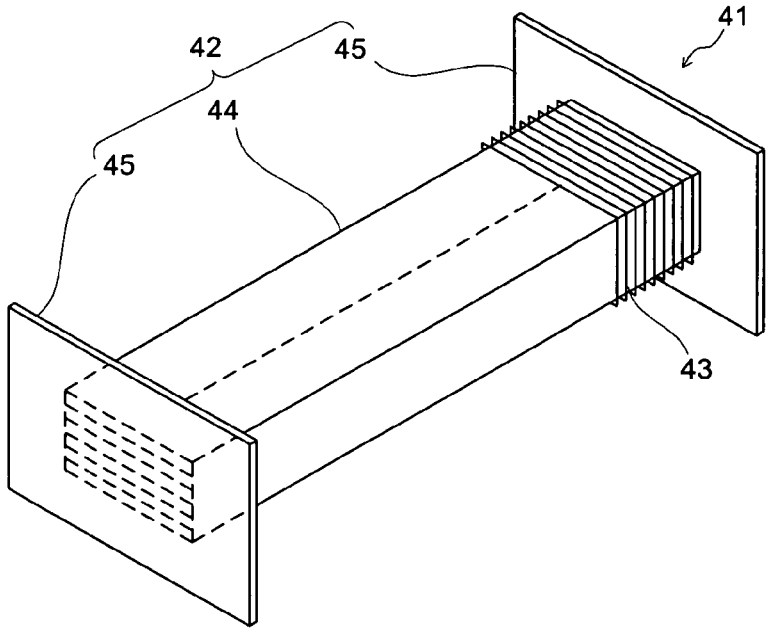
FIG. 11 is a perspective view showing an outline structure of an inductor according to a fifth embodiment of the invention.

An inductance element according to a fifth embodiment of the invention will be described with reference to FIG. 11 through FIG. 13. FIG. 11 is a perspective view showing an outline structure of an inductor according to the fifth embodiment of the invention. An inductor 41 shown in FIG. 11 is provided with a core (magnetic core) 42 having an open magnetic circuit structure and a coil (solenoid coil) 43 which is configured by winding a coil conductor around the core 42 by a prescribed number of turns. The core 42 has a multilayer body 44 which has plural magnetic alloy thin ribbons stacked in the same way as in the above-described embodiment. The insulating coating layer may be disposed on the outer circumference of the multilayer body 44 in the same manner as in the above-described individual embodiments, or the multilayer body 44 may be inserted and disposed in an insulating bobbin. It is desirable that the composition and shape of the magnetic alloy thin ribbons configuring the multilayer body 44 and the interlayer insulation and the like between the magnetic alloy thin ribbons are determined to be same as in the above-described embodiments.

Magnetic alloy thin ribbons 45 for ends which are same as the magnetic alloy thin ribbons which configure the multilayer body 44 are disposed on both ends of the above-described multilayer body 44 respectively. The magnetic alloy thin ribbons 45 for ends which are disposed on both ends of the multilayer body 44 are magnetically connected to the magnetic alloy thin ribbons which configure the multilayer body 44. The magnetic alloy thin ribbons 45 for ends are fixed to, for example, the multilayer body 44 with an adhesive agent. And, a through hole is formed in the magnetic alloy thin ribbons 45 for ends, and the multilayer body 44 may be inserted through the through holes and fixed. The magnetic alloy thin ribbons 45 for ends and the multilayer body 44 are not necessarily required to be contacted to one another but are desired to be disposed within at a distance of 1 mm in view of the magnetic connection.

Thus, when the magnetic alloy thin ribbons 45 for ends which are similar to the magnetic alloy thin ribbons which configure the multilayer body 44 are disposed at both ends of the multilayer body 44 which configures the core 42 respectively, the characteristics (inductance L and Q value) of the inductor 41 can be improved. The thickness of the magnetic alloy thin ribbons 45 for ends is in a negligible range with respect to the length (e.g., 16 to 25 mm) of the inductor 41, so that the magnetic alloy thin ribbons 45 for ends contribute to the improvement of the characteristics when the inductor 41 is made compact and short. And, it is also effective to configure the core by T-shaped magnetic alloy thin ribbons instead of the structure that the magnetic alloy thin ribbons 45 for ends are disposed at both ends of the multilayer body 44.

Figure 12:
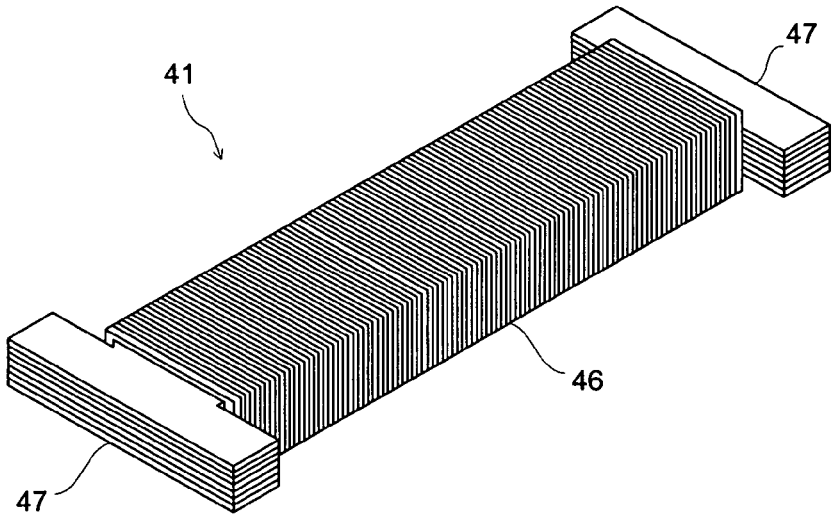
FIG. 12 is a perspective view showing an outline structure of another inductor according to the fifth embodiment of the invention.

The inductor 41 shown in FIG. 12 has an air core coil 46, which has a solenoid shape with winding wire gaps fixed by adhering, and T-shaped magnetic alloy thin ribbons 47 which are inserted into the air core coil 46 from its both ends. The T-shaped magnetic alloy thin ribbons 47 are stacked by inserting into the air core coil 46 from its both ends, and the multilayer body of the T-shaped magnetic alloy thin ribbons 47 configures the core. The T-shaped magnetic alloy thin ribbons 47 can be obtained by etching or pressing. Each corner may be rounded. By using the T-shaped magnetic alloy thin ribbons 47, the characteristics (inductance L and Q value) of the inductor 41 can be improved in the same manner as in the case that the magnetic alloy thin ribbons 45 for ends were disposed at both ends of the multilayer body 44.

The solenoid-shaped air core coil 46 can be obtained by using, for example, a cohesive wire. The cohesive can be bonded by heating or chemical treatment. The winding wire is generally circular, but a rectangular wire may be used to enhance air tightness. When the air core coil 46 is used, the T-shaped magnetic alloy thin ribbons 47 can be disposed after the winding step, so that it becomes possible to prevent stress degradation or the like due to winding. Besides, a gap between the air core coil 46 and the magnetic alloy thin ribbon 47 can be minimized. For example, a gap between the air core coil 46 and the multilayer body of the magnetic alloy thin ribbons 47 is preferably in a range of 0 to 0.1 mm. Thus, the Q value of the inductor 41 can be increased by closely contacting the coil 46 and the magnetic alloy thin ribbons 47.

Figure 13:
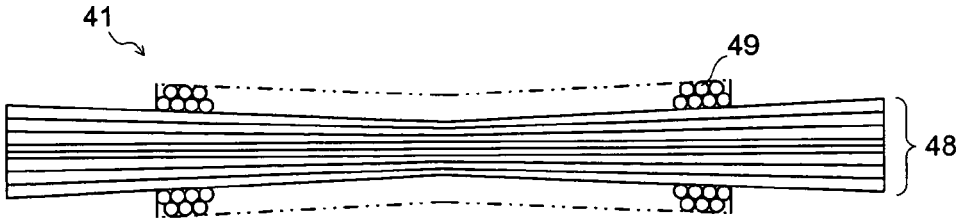
FIG. 13 is a sectional view showing a modified example of the inductor according to the fifth embodiment.

Besides, it is desirable that the inductor 41 of this embodiment has a multilayer body 48 of the magnetic alloy thin ribbons formed to have the center portion thinner than its both ends as shown in FIG. 13. By using the multilayer body 48 having such a shape, the multilayer body 48 can be fixed by a coil 49, and an effect of converging the magnetic flux becomes high. Therefore, it becomes possible to improve the receiving sensitivity when the inductor 41 is used as an antenna element.

It is desirable that the inductor 41 has a ratio (L•Q/Y) of a product (L•Q) of inductance L [mH] and Q value at 40 kHz to its length Y [mm] of 80 or more. Thus, good receiving sensitivity (voltage signal) can be obtained even if the length of the antenna element which is formed of the inductor 41 is made short. Besides, where the inductor 41 is dropped from a height of 10 m, it is desirable that a change rate of a product (L1•Q1) of inductance L1 [mH] and Q1 value at 40 kHz after dropping to the product (L•Q) of the inductance L [mH] and the Q value at 40 kHz prior to dropping is within ±0.3%. Thus, the decrease in receiving sensitivity due to deviation of resonance frequency can be suppressed by suppressing the degradation of characteristics due to the drop impact. This inductor 41 is suitable for the antenna element of a wristwatch type radio-controlled timepiece.

Figure 14A:
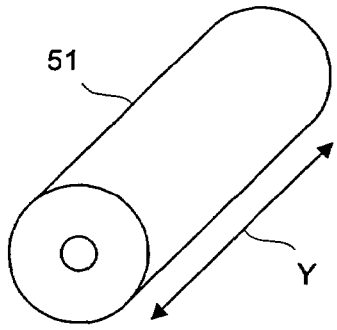
FIG. 14 are views showing an embodiment of a method for manufacturing an inductor of the invention.

An embodiment of a method for manufacturing the inductance element (inductor) of the invention will be described with reference to FIG. 14 and FIG. 15. FIG. 14 shows a process of manufacturing the inductance element (inductor) according to an embodiment of the invention. First, as shown in FIG. 14A, a wide amorphous magnetic alloy thin ribbon 51 is manufactured by a molten metal quenching method. A wide microcrystalline magnetic alloy thin ribbon or an amorphous alloy thin ribbon which is its forming material may be used instead of the wide amorphous magnetic alloy thin ribbon.

The wide magnetic alloy thin ribbon 51 means one having a width larger than a final size of the magnetic alloy thin ribbons which configure the core, and the amorphous magnetic alloy thin ribbon 51 produced by the molten metal quenching method is basically used. The wide amorphous magnetic alloy thin ribbon 51 manufactured by the molten metal quenching method is generally wound into a roll, and the wide amorphous magnetic alloy thin ribbon 51 in the rolled state is subjected to a heat treatment in a magnetic field. Specifically, the heat treatment is performed while applying a magnetic field to the wide amorphous magnetic alloy thin ribbon 51 in its width direction (direction of arrow Y in the figure) as shown in FIG. 14A.

The magnetic field applied is desirably larger than a demagnetizing field which is produced depending on the thickness and width of the amorphous magnetic alloy thin ribbons 51 and magnetization at the heat treatment temperature. The heat treatment temperature is required to be lower than an amorphous alloy crystallization temperature and a Curie temperature. The amorphous magnetic alloy thin ribbon 51 becomes brittle when the heat treatment time is made long, so that it is desirable that the heat treatment time is decreased in a range that a desired frequency characteristic can be obtained. Magnetic anisotropy is given to the wide amorphous magnetic alloy thin ribbon 51 in its width direction by the heat treatment in a magnetic field.

Figure 14B:
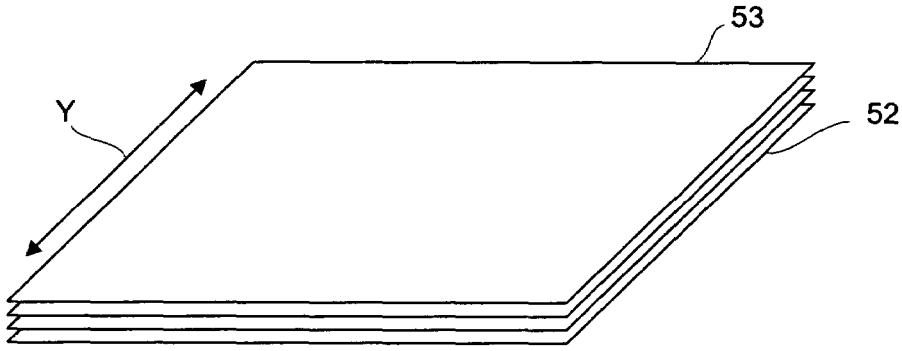

Then, an insulating coating (not shown) is formed on the surface of the wide amorphous magnetic alloy thin ribbon 51. For insulating coating, for example, an insulating resin coating, an insulating oxide coating, a powder adhered layer, a surface oxide film and the like can be used. The wide amorphous magnetic alloy thin ribbon 51 is preliminarily cut into an appropriate length as shown in FIG. 14B, and preliminarily cut wide amorphous magnetic alloy thin ribbons 52 are stacked in desired number. A multilayer body 53 is fixed with, for example, an insulating resin.

Figure 14C:
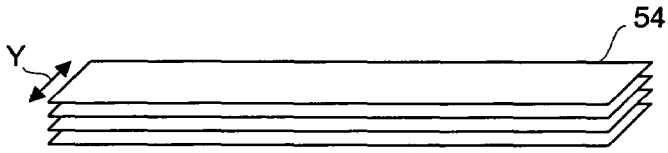

Then, the multilayer body 53 is cut depending on the width of the magnetic alloy thin ribbons which configure the core as shown in FIG. 14C. A multilayer body 54 cut in the width direction has a final sized width. Here, the side of the multilayer body 54 is a cut surface, and the ends of the magnetic alloy thin ribbons in the width direction are exposed, so that there is a possibility of bridging by cut burr or the like. Therefore, it is desirable to remedy the bridge at the ends of the magnetic alloy thin ribbons in the width direction by conducting the light etching of the multilayer body 54. This light etching is performed so that the ends of the magnetic alloy thin ribbons in the width direction are positioned on the inward side of the ends of the insulating interlayer (the above-described insulating coating).

Specifically, it is desirable to perform light etching so that the ends of the magnetic alloy thin ribbons in the width direction retreat by 0.001 mm or more, and preferably 0.01 mm or more, from the ends of the insulating interlayer. The retreated distance d is 0.4 mm or less, and preferably 0.1 mm or less, as described above. This light etching is performed to prevent a short circuit from occurring at the ends of the magnetic alloy thin ribbons in the width direction and may be omitted if the occurrence of burr due to cutting in the width direction can be suppressed.

Figure 14D:
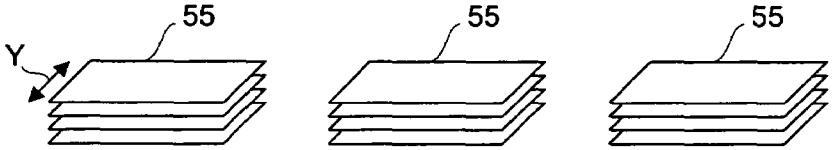

Then, the multilayer body 54 is cut according to the length of the magnetic alloy thin ribbons configuring the core as shown in FIG. 14D. And, the light etching may be performed after cutting as measures against burr. Multilayer bodies 55 undergone the cutting in the longitudinal direction have a final shape as the core. And, magnetic anisotropy is applied to the magnetic alloy thin ribbons in the width direction according to the heat treatment in a magnetic field performed on the wide amorphous magnetic alloy thin ribbons 51. The magnetic anisotropy applied to the magnetic alloy thin ribbons may be an oblique direction with respect to the longitudinal direction of the thin ribbons as indicated in the above-described embodiments.

Thus, the wide amorphous magnetic alloy thin ribbon 51 which was undergone the heat treatment in a magnetic field is cut to the final sized width, so that lowering of anisotropy due to the influence of the demagnetizing field can be suppressed. In other words, even the wide amorphous magnetic alloy thin ribbon 51 has the occurrence of demagnetizing field at its ends in the width direction, but the influence of the demagnetizing field in the cutting step later is eliminated. Therefore, even if the width of the magnetic alloy thin ribbon is narrowed to 15 mm or less, it becomes possible to stably give sufficient magnetic anisotropy to the magnetic alloy thin ribbons in the width direction. If the heat treatment in a magnetic field is performed after cutting in the same way as a related art, an influence of the demagnetizing field becomes high, and the magnetic anisotropy becomes low.

A target inductor can be obtained by using the multilayer body 55 of the magnetic alloy thin ribbons as the core and forming a coil by winding around the core. By the produced inductor, it becomes possible to improve the inductance value because the sufficient magnetic anisotropy is given in the width direction of the magnetic alloy thin ribbons configuring the core. The wide amorphous magnetic alloy thin ribbon 51 may be cut to a desired length from the beginning without performing the temporally cutting step shown in FIG. 14B. The same effect can also be obtained by stacking the amorphous magnetic alloy thin ribbons 51.

Figure 15A:
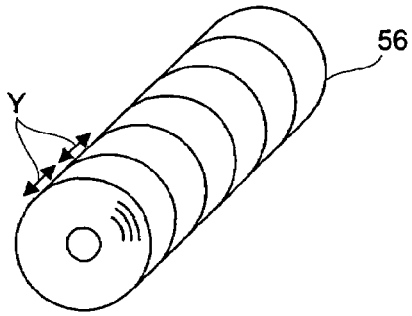
FIG. 15 are views showing another embodiment of the method for manufacturing an inductor of the invention.
Figure 15B:
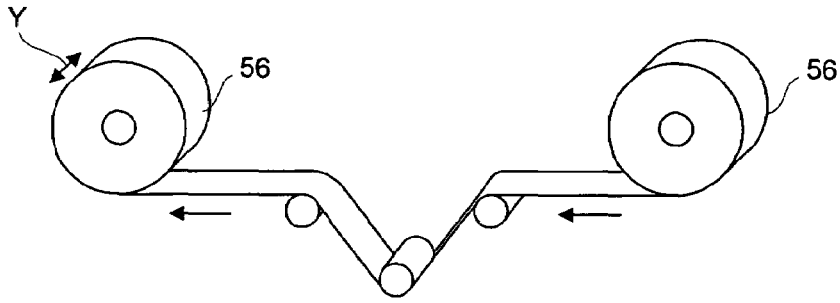
Figure 15C:
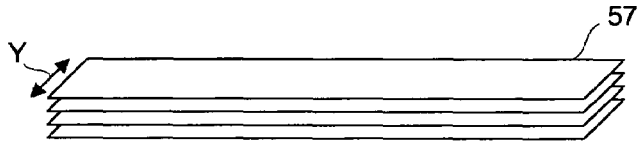
Figure 15D:
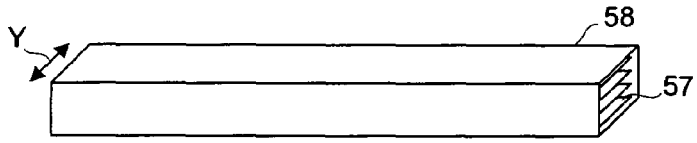

Besides, as shown in FIG. 15, after the insulating coating is formed on the surface of the wide amorphous magnetic alloy thin ribbon which has undergone the heat treatment in a magnetic field, the wide amorphous magnetic alloy thin ribbon is rewound, and the rewound wide amorphous magnetic alloy thin ribbons may be cut according to the final width of the magnetic alloy thin ribbon (FIG. 15A). The amorphous magnetic alloy thin ribbon 56 cut to the final width is undergone light etching (FIG. 15B). Then, the amorphous magnetic alloy thin ribbon 56 is preliminarily cut to an appropriate length, and the cut bands 56 are stacked in desired numbers (FIG. 15C). A multilayer body 57 is inserted and fixed in an insulating tube (e.g., heat shrinkable tube) 58 (FIG. 15D).

Figure 15E:
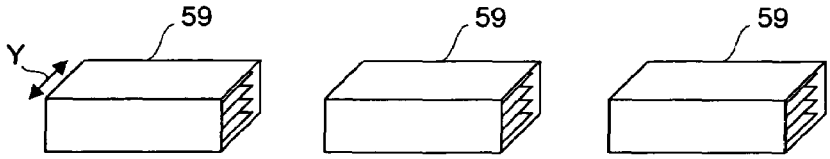

The method of fixing the multilayer body 57 is not limited to the fixing method using an insulating tube. For example, a method of stacking a reinforcing material of silicon steel plate or the like on both outer layers of the multilayer body 57 and fixing the multilayer body together with these reinforcing materials with a fixing band, a method of fixing by a resin impregnation method, or the like may be used. The light etching may be omitted if the occurrence of burr due to cutting in the width direction can be suppressed. Then, the multilayer body 57 fixed with the insulating tube 58 is cut depending on a length of the magnetic alloy thin ribbons configuring the core (FIG. 15E). A cut multilayer body 59 has a final shape as the core.

Lowering of anisotropy due to the influence of demagnetizing field can also be suppressed by such a manufacturing process because the wide amorphous magnetic alloy thin ribbon 51 which has undergone the heat treatment in a magnetic field is cut to a final sized width. It may also be configured such that the amorphous magnetic alloy thin ribbon 56 which was cut to the final sized width is cut to a desired length from the beginning, and the multilayer body formed by stacking a desired number of the cut amorphous magnetic alloy thin ribbons 56 is inserted and fixed in the insulating tube. And, the multilayer body 59 of the magnetic alloy thin ribbons is used as the core, and a coil is formed by winding around the core to obtain the target inductor.

The inductor manufactured according to the manufacturing process in the above-described embodiment is also used as a magnetic sensor or the like such as an antenna element or a direction sensor in the same way as the inductor of the above-described individual embodiments. The manufactured inductor is suitable as data carrier parts such as an EF tag having a signal carrier frequency of 120 to 140 kHz or a pen tag having a signal carrier frequency of about 500 kHz, or an antenna element for a radio-controlled timepiece having a signal carrier frequency of 40 to 120 kHz. The inductors are applied to the data carrier parts or the antenna element of a radio-controlled timepiece, so that such equipment can be made compact and high performance. The inductor is suitably used for portable equipment.

Figure 16:
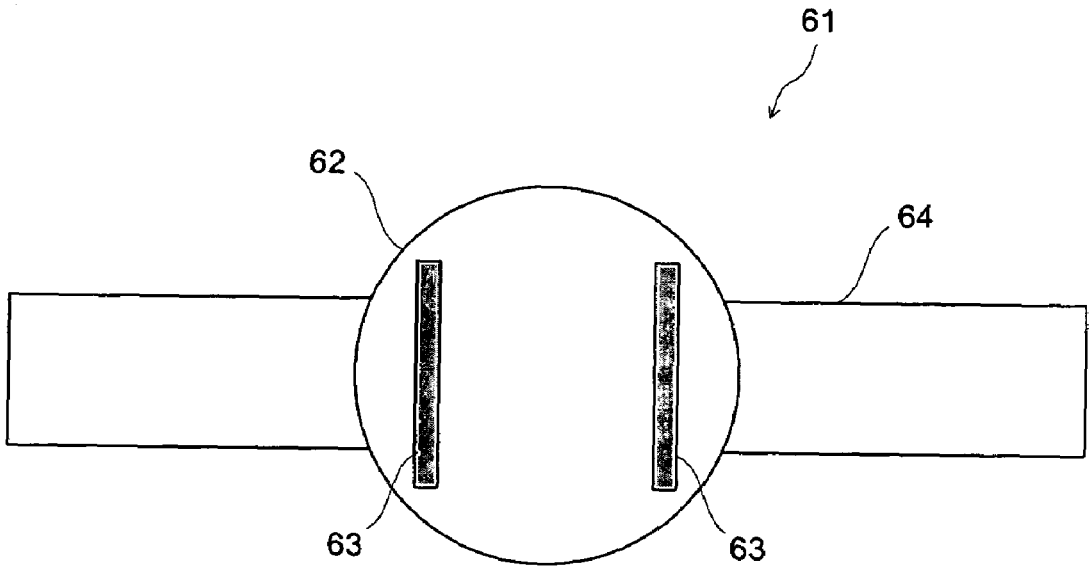
FIG. 16 is a view showing a structure example of a wristwatch type radio-controlled timepiece using as an antenna element an inductor according to an embodiment of the invention.

In a case where the inductors according to the above-described embodiments are applied to the antenna element, plural inductors may be used by electrically connecting in series. FIG. 16 is a diagram showing a structure example of a wristwatch type radio-controlled timepiece with the inductors of the individual embodiments used as the antenna elements. A wristwatch type radio-controlled timepiece 61 has plural inductors 63 which are disposed within a timepiece body 62. These plural inductors 63 are electrically connected in series. The individual inductors 63 configure a source inductor. The antenna element for the wristwatch type radio-controlled timepiece 61 is configured of the plural inductors 63 which are connected in series.

Thus, by configuring the antenna element by the plural inductors 63, antenna characteristics corresponding to a total length of the plural inductors 63 can be obtained without being restricted by a disposing position. It contributes to the improvement of the receiving sensitivity of the radio-controlled timepiece, which has a restricted disposed position for the antenna element, like a wristwatch type radio-controlled timepiece. For example, a radio-controlled timepiece which requires an inductor of about 20 mm can obtain the equivalent antenna characteristics by disposing two inductors of about 10 mm. At this time, the individual inductors 63 are disposed to have the shortest distance of 3 mm or more between them. If the shortest distance between the individual inductors 63 is less than 3 mm, they interfere with each other, and the Q value required for the antenna characteristics is degraded. The distance between the inductors 63 is appropriately determined depending on a mounting area or the like within the radio-controlled timepiece but preferably within 45 mm practically.

Besides, the individual inductors 63 configuring the antenna element are not limited to be disposed within the timepiece body 62 but may be disposed within a belt portion 64. For the inductors disposed within the belt portion 64, it is desirable to use the inductance element which does not have a large degradation of the characteristics when it is bent as described in the first embodiment. Thus, by disposing the inductors which configure the antenna element within the belt portion 64, it becomes possible to configure the wristwatch type radio-controlled timepiece, for example, a very small wrist watch which could hardly house the antenna element within the timepiece body. The antenna element may be configured of only one inductor which is disposed within the belt portion 64.

Specific examples and their evaluated results of the invention will be described below.

EXAMPLES 1 TO 5, REFERENCE EXAMPLE 1 & 2, COMPARATIVE EXAMPLES 1 & 2

First, 30 amorphous magnetic alloy thin ribbons having an alloy composition of $(Co_{0.90}Fe_{0.05}Mn_{0.02}Nb_{0.03})_{71}Si_{15}B_{14}$ and a thickness of 17 μm, a width of 0.8 mm and a length of 50 mm were prepared. The surfaces of the amorphous magnetic alloy thin ribbons were insulated with $SiO_2$, and they were stacked. The multilayer body of the amorphous magnetic alloy thin ribbons was inserted into a silicone resin tube having an outer diameter of 1.5 mm, a thickness of 0.2 mm and a length of 50 mm (Example 1) to produce a core. The multilayer body of the amorphous magnetic alloy thin ribbons was inserted into the same shaped polyethylene resin tube (Example 2), polypropylene resin tube (Example 3), polyamide resin tube (Example 4), and styrene rubber tube (Example 5) to produce cores.

A phenol resin tube (Reference Example 1) and an epoxy resin tube (Reference Example 2) having the same shape were used to produce the same cores as in the examples. Besides, a multilayer body having amorphous magnetic alloy thin ribbons mutually adhered with an epoxy resin (Comparative Example 1) and a multilayer body having a multilayer body of amorphous magnetic alloy thin ribbons impregnated with an epoxy resin (Comparative Example 2) were used to produce the same cores as in the examples.

Coils were produced by winding the coil conductor for 30 turns around the cores of the examples described above to produce the inductors. The inductors were bent to have a distance of 20 mm between their ends, and their characteristics were evaluated. Specifically, a change rate ($L/L_0$) of an initial inductance value $L_0$ in a linear state and an inductance value L in a bent state with respect to the initial inductance value $L_0$ was determined. And, the core's bendability was evaluated depending on whether or not the core could be bent to the above-described shape. Besides, durability was evaluated depending on whether or not the insulating tube could withstand when the coil conductor was wound around the core, and the state of the winding wire was evaluated. The measured and evaluated results are shown in Table 2.

TABLE 2

| | Core Insulating coating material | Evaluated results: Inductance (Initial value) $L_0$ | $L/L_0$ (%) | State of insulating coating | Bent state of core | State of coil |
|---|---|---|---|---|---|---|
| E1 | Silicone resin | 10.8 | 112 | Good | Good | No abnormality |
| E2 | Polyethylene resin | 10.8 | 111 | Good | Good | No abnormality |
| E3 | Polypropylene resin | 10.8 | 107 | Good | Good | No abnormality |
| E4 | Polyamide resin | 10.8 | 107 | Good | Good | No abnormality |
| E5 | Styrene rubber | 10.8 | 109 | Good | Good | No abnormality |
| RE1 | Phenol resin | 10.8 | 86 | No good (broken) | Good | Flawed |
| RE2 | Epoxy resin | 10.8 | 85 | No good (broken) | Good | Flawed |
| CE1 | (Epoxy resin adhered multilayer) | 10.9 | 50 | Good | No good (ruptured) | Flawed |
| CE2 | (Epoxy resin impregnation of multilayer) | 11.1 | 52 | Good | No good (ruptured) | Flawed |

E = Example;
RE = Reference Example;
CE = Comparative Example

It is apparent from Table 2 that the inductors of Examples 1 to 5 are good in bendability, and good inductance is kept even in a bent state. The inductors of Reference Examples 1 and 2 are good in bendability, but the insulating tubes have poor durability, so that it is seen that practical utility is poor in comparison with those of Examples. Specifically, it was found that the inductors according to Reference Examples 1 and 2 had a broken insulating tube and an unwound winding wire, and the magnetic alloy thin ribbon and the winding wire were contacted to damage the winding wire. It was confirmed that the inductors of Comparative Examples 1 and 2 were hardly bent, and it was practically impossible to mount them in a bent state. Specifically, the adhered magnetic alloy thin ribbons were separated when a force was applied, and the magnetic alloy thin ribbons were broken to damage the winding wire.

EXAMPLE 6

Inductors were produced in the same way as in Example 1 except that amorphous magnetic alloy thin ribbons having different surface roughness Rf were used in Example 1. A ratio ($L/L_0$) of inductance L in a bent state (a bent state so that a distance between ends becomes 20 mm) with respect to inductance $L_0$ in a straight state of the individual inductors, and a ratio ($Q/Q_0$) of Q value (Q) in the bent state with respect to the Q value ($Q_0$) in the linear state were measured and evaluated. The results are shown in Table 3 and FIG. 17.

TABLE 3

| Sample No. | Surface roughness Rf | Inductance: Initial $L_0$ | When bent L | $L/L_0$ | Q value: Initial $Q_0$ | When bent Q | $Q/Q_0$ |
|---|---|---|---|---|---|---|---|
| 1 | 0.05 | 10.8 | 8.9 | 0.83 | 28.4 | 16.1 | 0.55 |
| 2 | 0.10 | 10.7 | 11.1 | 1.03 | 28.3 | 22.2 | 0.76 |
| 3 | 0.18 | 10.7 | 12.1 | 1.13 | 28.7 | 23.9 | 0.81 |
| 4 | 0.20 | 10.5 | 12.0 | 1.14 | 28.9 | 24.4 | 0.82 |

TABLE 3-continued

| Sample No. | Surface roughness Rf | Inductance: Initial $L_0$ | When bent L | $L/L_0$ | Q value: Initial $Q_0$ | When bent Q | $Q/Q_0$ |
|---|---|---|---|---|---|---|---|
| 5 | 0.25 | 10.4 | 12.3 | 1.19 | 29.0 | 24.8 | 0.83 |
| 6 | 0.30 | 10.3 | 11.9 | 1.16 | 29.1 | 24.0 | 0.80 |
| 7 | 0.38 | 10.1 | 10.6 | 1.05 | 29.3 | 22.6 | 0.75 |
| 8 | 0.45 | 9.9 | 9.5 | 0.96 | 29.5 | 21.6 | 0.71 |
| 9 | 0.50 | 9.5 | 8.5 | 0.90 | 29.6 | 19.2 | 0.63 |
| 10 | 0.60 | 9.4 | 6.5 | 0.69 | 29.5 | 15.2 | 0.50 |

Figure 17:
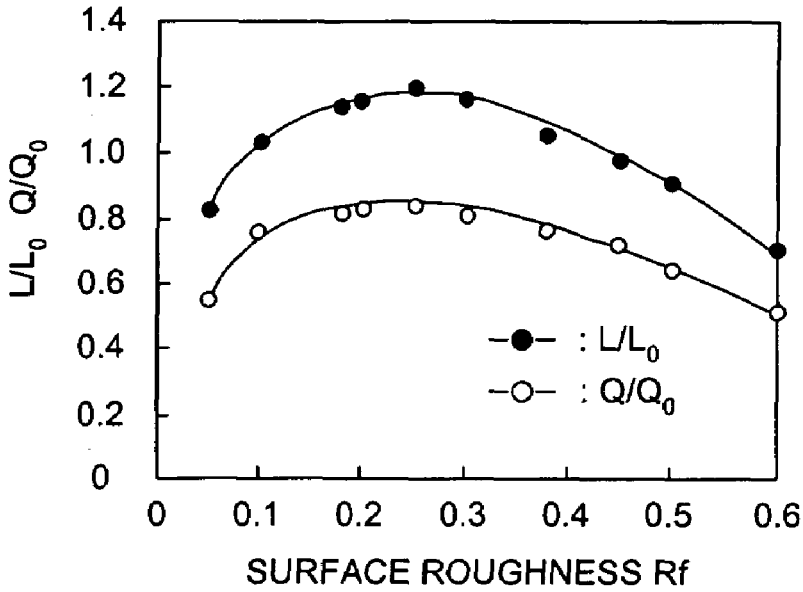
FIG. 17 is a diagram showing a relationship between the surface roughness of magnetic alloy thin ribbons and inductance and Q values according to Example 6 of the invention.

It is apparent from Table 3 and FIG. 17 that the surface roughness Rf of the amorphous magnetic alloy thin ribbons is preferably in a range of 0.08 to 0.45. The surface roughness Rf of the amorphous magnetic alloy thin ribbons is preferably in a range of 0.1 to 0.35. Bendability and the like are improved by using the amorphous magnetic alloy thin ribbons having the above surface roughness Rf, so that the inductance value and Q value can be enhanced in the bent state.

EXAMPLE 7

Figure 18:
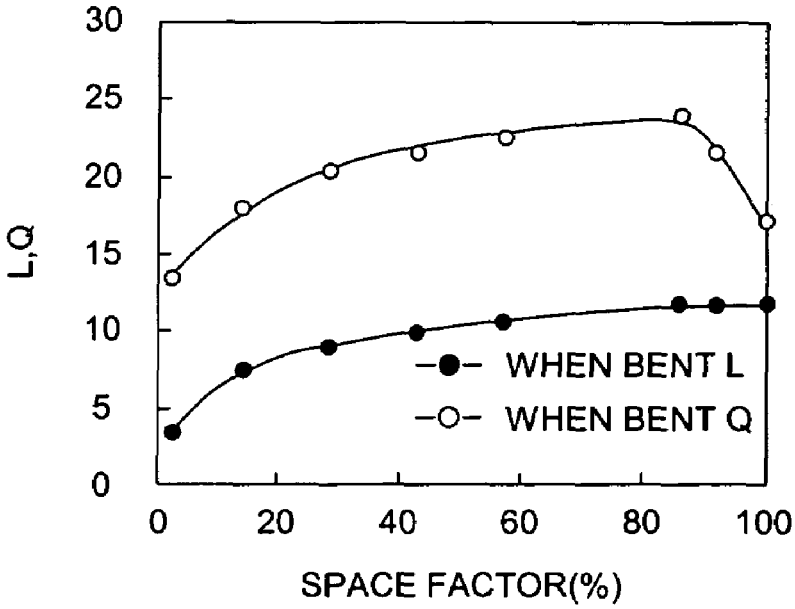
FIG. 18 is a diagram showing a relationship between a space factor of a magnetic alloy thin ribbon and an inductance value and Q value in a bent state according to Example 7 of the invention.
Figure 19:
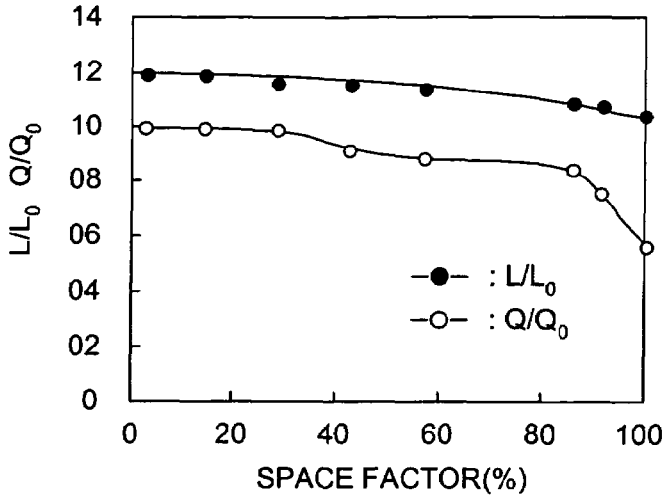
FIG. 19 is a diagram showing a relationship between a space factor of the magnetic alloy thin ribbon and an L/L0 ratio and $Q/Q_0$ ratio according to Example 7 of the invention.

Inductors were produced in the same manner as in Example 1 except that the number of stacked layers of the amorphous magnetic alloy thin ribbons in Example 1 was changed to change the space factor in the tube. A ratio ($L/L_0$) of inductance L in a bent state (the same bent state as in Example 6) to inductances $L_0$, $L_0$ of the inductors in a straight state, Q value in the same straight state, and a ratio ($Q/Q_0$) of Q value (Q) in the bent state to $Q_0$ were measured and evaluated. The results are shown in Table 4, FIG. 18 and FIG. 19. FIG. 18 shows changes of L and Q with respect to the space factor when the inductor is in a bent state. FIG. 19 shows changes of $L/L_0$ ratio and $Q/Q_0$ ratio with respect to the space factor.

TABLE 4

| Sample No. | Magnetic alloy thin ribbon Q'ty | Space factor (%) | Inductance Initial $L_0$ | Value L per layer | When bent L | $L/L_0$ | Q value Initial $Q_0$ | When bent Q | $Q/Q_0$ |
|---|---|---|---|---|---|---|---|---|---|
| 1 | 1 | 3 | 2.9 | 2.9 | 3.47 | 1.18 | 13.5 | 13.3 | 0.99 |
| 2 | 5 | 14 | 6.4 | 1.3 | 7.56 | 1.18 | 18.1 | 17.8 | 0.98 |
| 3 | 10 | 29 | 7.8 | 0.8 | 8.94 | 1.15 | 20.7 | 20.3 | 0.98 |
| 4 | 15 | 43 | 8.7 | 0.3 | 10.0 | 1.15 | 23.7 | 21.5 | 0.91 |
| 5 | 20 | 57 | 9.3 | 0.5 | 10.5 | 1.13 | 25.8 | 22.5 | 0.87 |
| 6 | 30 | 86 | 10.7 | 0.4 | 11.6 | 1.08 | 28.7 | 23.9 | 0.83 |
| 7 | 32 | 91 | 10.8 | 0.3 | 11.5 | 1.03 | 29.2 | 21.5 | 0.74 |
| 8 | 35 | 100 | 11.2 | 0.3 | 11.5 | 1.03 | 30.0 | 16.5 | 0.55 |

It is apparent from Table 4, FIG. 18 and FIG. 19 that the Q value in the bent state can be kept high by determining the space factor in the tube by the amorphous magnetic alloy thin ribbons to be 90% or less. But, if the space factor in the tube is too low, values $L_0$ and $Q_0$ become small. Therefore, it is desirable that the space factor of 20% or more is secured in practical use. It is more desirable that the space factor is 40% or more.

EXAMPLE 8

An amorphous magnetic alloy thin ribbon having an alloy composition of $(Co_{0.95}Fe_{0.05})_{75}(Si_{0.5}B_{0.5})_{25}$ and a thickness of 15 μm and a width of 35 mm was prepared. Magnetic field of 1000 A/m was applied to the amorphous magnetic alloy thin ribbon in its width direction, and it was thermally treated at 200° C. for 180 minutes. Then, the surface of the amorphous magnetic alloy thin ribbon was coated with an epoxy resin, and the amorphous magnetic alloy thin ribbon was fabricated so to have a width of 2 mm. The amorphous magnetic alloy thin ribbon was prepared in plural in a length of 5 to 80 mm. Twenty of the amorphous magnetic alloy thin ribbons were stacked and fixed with the epoxy resin. A winding wire was wound around the multilayer body with an inner diameter of 3 mm, 100 turns and a length of 8 mm. The above coil length a was determined constant to be 8 mm, and the inductance values of the individual inductors having a core length b in a range of 5 to 80 mm were measured. The measured results are shown in FIG. 20.

Figure 20:
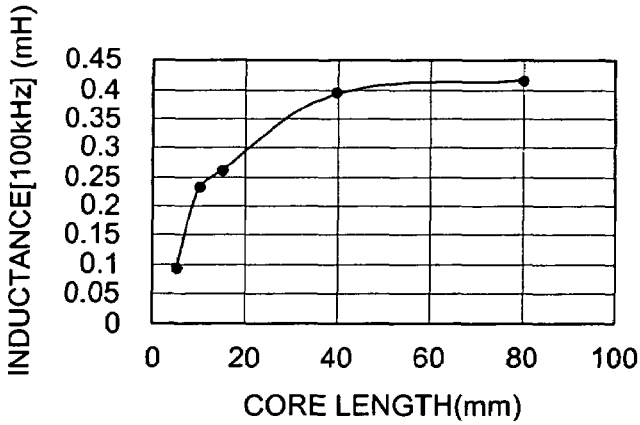
FIG. 20 is a diagram showing a relationship between a core length and inductance assuming that the coil length according to Example 8 of the invention is constant.
Figure 21:
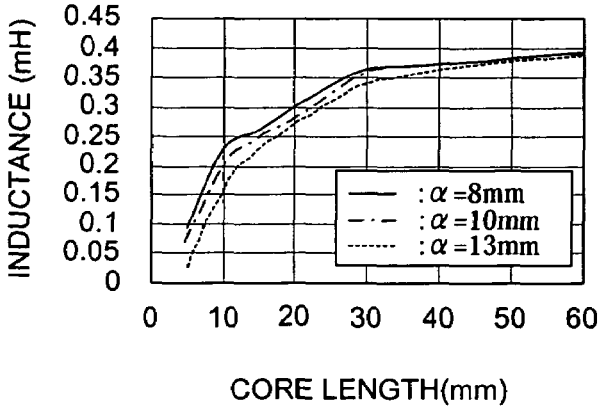
FIG. 21 is a diagram showing a relationship among a coil length and a core length and inductance according to Example 8 of the invention.

It is apparent from FIG. 20 that when the coil length a is 8 mm, good inductance can be obtained by setting the core length b to 10 mm or more. FIG. 21 shows the inductance values (measured values) of the individual inductors with the core length b varied in a range of 5 to 80 mm when the coil length a was set to 8 mm, 10 mm, and 13 mm. In each case, it is seen that when the relationship between the coil length a and the core length b becomes a>b—2 [mm], the inductance becomes small sharply. Besides, it is also seen that where the relationship between the coil length a and the core length b satisfies a≦b−4 [mm], better inductance can be obtained.

EXAMPLE 9

Figure 22:
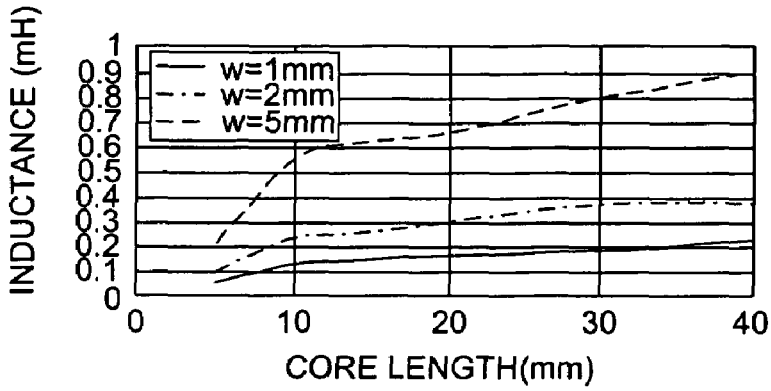
FIG. 22 is a diagram showing a relationship between a core length and inductance when amorphous magnetic alloy thin ribbons having a different width according to Example 9 of the invention are used.
Figure 23:
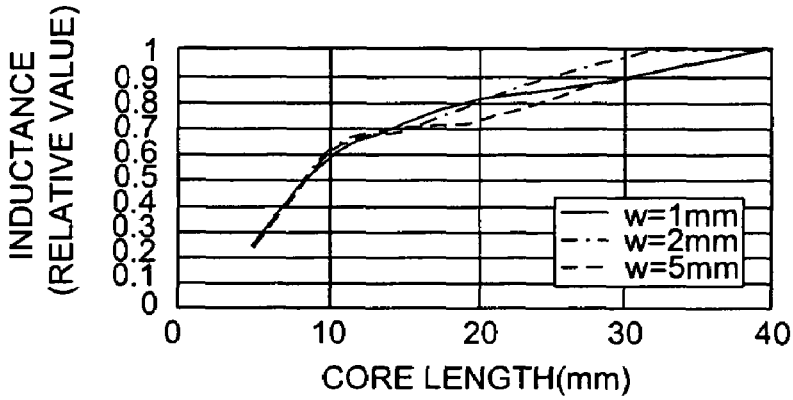
FIG. 23 is a diagram showing the inductance of FIG. 22 in relative value.

Inductors were produced in the same manner as in Example 8 except that the fabrication of the amorphous magnetic alloy thin ribbons after the heat treatment in a magnetic field was changed to a width w of 1 mm, 2 mm and 5 mm, and the inner diameter of the coil wound around the core was changed to 2 mm, 3 mm and 7 mm in Example 8. The inductance values of the individual inductors having the core length b in a range of 5 to 80 mm were measured. The measured results are shown in FIG. 22. FIG. 23 shows the inductance values in FIG. 22 indicated as relative values. It is apparent from FIG. 23 that when the relationship between the coil length a and the core length b becomes a>b−2 [mm], inductance becomes small sharply. Besides, it is seen that when the relationship between the coil length a and the core length b satisfies a≦b−4 [mm], better inductance can be obtained.

EXAMPLE 10

Amorphous magnetic alloy thin ribbons undergone the heat treatment under the conditions shown in Table 5 were fabricated to a width of 2 mm and a length of 30 mm, and a polyimide based insulating film was applied to their surfaces, and their calcination was performed. Twenty amorphous magnetic alloy thin ribbons were stacked and fixed with an epoxy resin. Inductors were produced by winding a winding wire around the individual multilayer bodies with an inner diameter of 4 mm, and 100 turns. As comparative samples, inductors were produced by using amorphous magnetic alloy thin ribbons without forming an insulating film on their surfaces.

TABLE 5

| Sample Name | Composition | Thickness (μm) | Heat treatment temperature (° C.) | Heat treatment time (min) |
|---|---|---|---|---|
| S-A | $(Fe_{1-x}Co_x)_{78}(SiB)_{22}$ | 15 | 140 | 180 |
| S-B | $(Fe_{1-x}Co_x)_{78}(SiB)_{22}$ | 15 | 160 | 240 |
| S-C | $(Fe_{1-x}Co_x)_{78}(SiB)_{22}$ | 15 | 180 | 190 |
| S-D | $(Fe_{1-x}Co_x)_{78}(SiB)_{22}$ | 15 | 200 | 60 |
| S-E | $(Fe_{1-x}Co_x)_{78}(SiB)_{22}$ | 15 | 190 | 160 |

Figure 24:
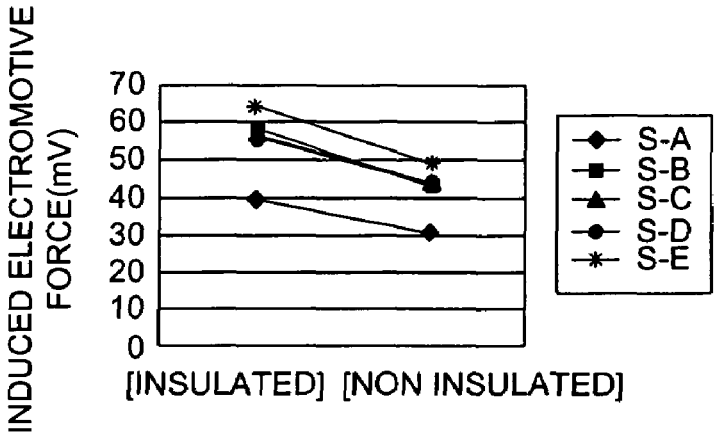
FIG. 24 is a diagram showing an induced electromotive force compared between cases where amorphous magnetic alloy thin ribbons are insulated and not insulated according to Example 10 of the invention.

Induced electromotive forces produced in the individual inductors by an electromagnetic field having a frequency of 100 kHz produced by a solenoid coil which was position 1 m away were measured. The measured results are shown in FIG. 24. It is apparent from FIG. 24 that the induced electromotive force lowers when an interlayer insulating film is not disposed between the amorphous magnetic alloy thin ribbons. It was caused by a loss of eddy current due to the insulating films.

The above-described multilayer bodies of the amorphous magnetic alloy thin ribbons were undergone light etching with the conditions changed to produce the cores having different distance d shown in FIG. 8. Then, a winding wire was wound around the cores to produce inductors. Each sample had the multilayer body fixed with an epoxy resin and the side surface polished, and the amorphous magnetic alloy thin ribbons of the multilayer body were etched with a 30% HCl solution. The distance d was varied by changing the duration of etching.

Thirty of such inductors were produced, and the individual induced electromotive forces were measured by the above-described method. As to the measured results, when standard deviation of the Q value becomes 10% or more, it was judged defective because variation was large. The results are shown in Table 6. It is seen from Table 6 that d is preferably 0.001 mm or more. If d is too large, the core becomes large with the size of the amorphous magnetic alloy thin ribbons important for the magnetic characteristics remained constant, so that d is 0.4 mm or less, and desirably 0.1 mm or less.

TABLE 6

| d (mm) | Judged results of induced electromotive force |
|---|---|
| 0 | No good |
| 0.001 | Good |
| 0.01 | Good |
| 0.1 | Good |
| 0.4 | Good |

EXAMPLE 11

In the same manner as in Example 8 described above, the amorphous magnetic alloy thin ribbons having a thickness of 15 μm×a width of 35 mm were subjected to the heat treatment in a magnetic field and cut so to have a width of 2 mm. Sixteen of the amorphous magnetic alloy thin ribbons (length of 13 mm) were stacked and fixed with an epoxy resin. A winding wire was wound around the multilayer body by 150 turns to produce an inductor. As Comparative Example, a similar inductor was produced by using amorphous magnetic alloy thin ribbons which were undergone the heat treatment in a magnetic field after cutting to a width of 2 mm. Each heat treatment was performed under conditions at 200° C. for 180 min by applying a magnetic field of 40 kA/m in a width direction.

Figure 25:
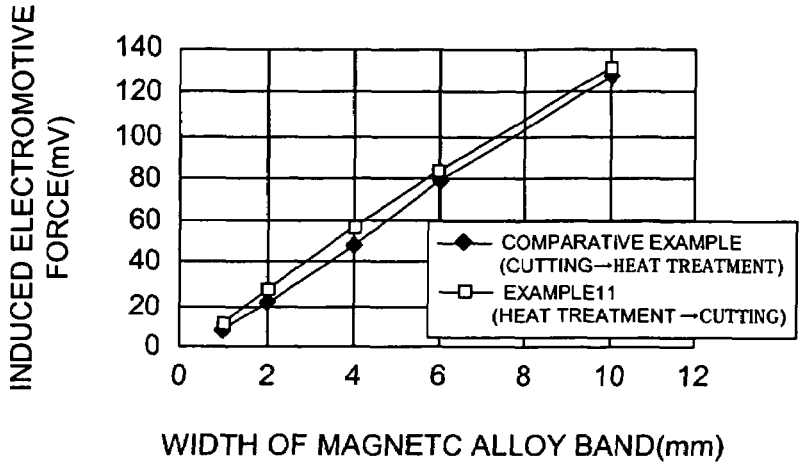
FIG. 25 is a diagram showing induced electromotive force compared between a case where a wide thin ribbon is subjected to a heat treatment in a magnetic field and cut and a case where a heat treatment in a magnetic field is performed after cutting according to Example 11 of the invention.
Figure 26:
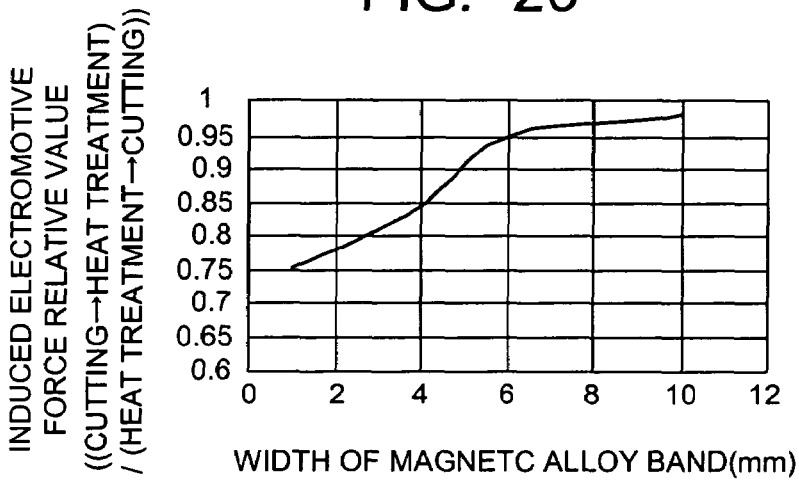
FIG. 26 is a diagram showing the induced electromotive force of FIG. 25 in relative value.

The individual inductors were measured for the induced electromotive force in the same manner as in Example 10. The results are shown in FIG. 25 and FIG. 26. FIG. 26 shows the induced electromotive force in the relative value. It is apparent from the figures that when the final width is broad, the characteristics obtained by the heat treatment before and after cutting do not change substantially, but when the width is about 4 mm or less, better characteristics can be obtained when the heat treatment in a magnetic field is performed with the broad width before cutting. Specifically, when a width is 5 mm or less, the characteristics are improved by 10% or more by performing the heat treatment before cutting.

EXAMPLE 12

An amorphous magnetic alloy thin ribbon having an alloy composition of $(Co_{0.95}Fe_{0.05})_{75}(Si_{0.55}B_{0.45})_{25}$, a thickness of 15 μm and a width of 35 mm was prepared. Magnetic field of 1000 A/m was applied to the amorphous magnetic alloy thin ribbon in its width direction, and it was thermally treated at 200° C. for 180 minutes. Then, the surface of the amorphous magnetic alloy thin ribbon was coated with an epoxy resin, and it was prelimarily cut to an appropriate length. Sixteen of it were stacked and fixed with the epoxy resin, and the multilayer body was subjected to light etching. Then, the multilayer body was cut to a width of 4 mm, and further cut to a length of 13 mm.

Figure 27:
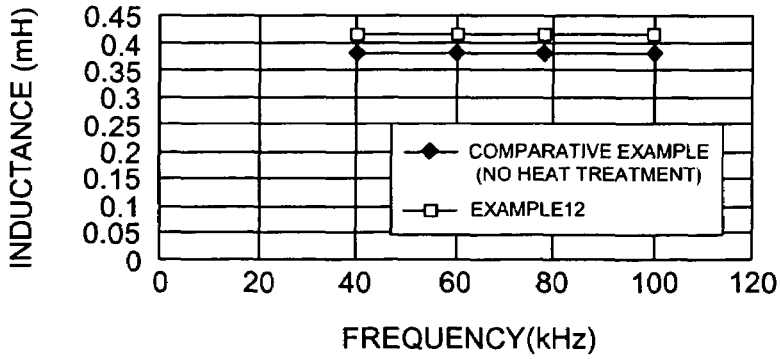
FIG. 27 is a diagram showing a relationship between inductance and frequency of the inductor according to Example 12 of the invention.

The multilayer body was used for the core, and a winding wire was wound around it by 150 turns to obtain an inductor. The obtained inductor was measured for inductance. The results are shown in FIG. 27. Comparative Example in FIG. 27 indicates a measured result of the inductor using the amorphous magnetic alloy thin ribbons not undergone the heat treatment in a magnetic field. It is apparent from FIG. 27 that the characteristics are improved by 8% or more in inductance value because good magnetic anisotropy is applied to the thin ribbons in the width direction in this example.

EXAMPLE 13

The same amorphous magnetic alloy thin ribbon as in Example 12 was prepared, a magnetic field of 1000 A/m was applied to the amorphous magnetic alloy thin ribbon in the width direction, and the heat treatment was performed at 200° C. for 180 minutes. Then, the surface of the amorphous magnetic alloy thin ribbon was coated with an epoxy resin, and the amorphous magnetic alloy thin ribbon was cut to a width of 4 mm. The amorphous magnetic alloy thin ribbon was subjected to light etching and preliminarily cut to an appropriate length. Sixteen of it were stacked, inserted and fixed in a heat shrinkable tube. Then, the multilayer body fixed by the heat shrinkable tube was cut to a length of 13 mm.

Figure 28:
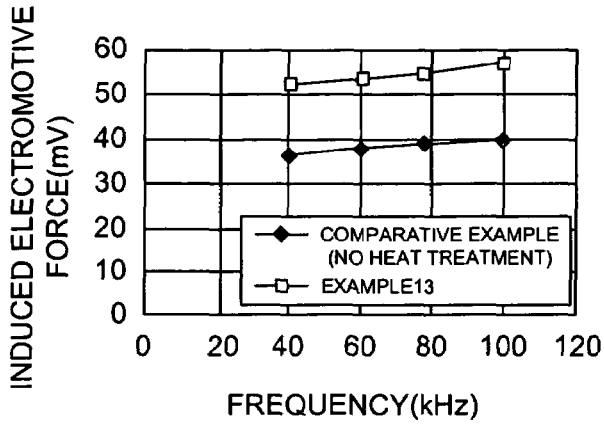
FIG. 28 is a diagram showing a relationship between inductance and frequency of the inductor according to Example 13 of the invention.

The multilayer body was used as a core, and a winding wire was wound around it by 150 turns to prepare an inductor. The obtained inductor was measured for an induced electromotive force. The results are shown in FIG. 28. Comparative Example in FIG. 28 indicates a measured result of the inductor using the amorphous magnetic alloy thin ribbon not undergone the heat treatment in a magnetic field. According to this example, good magnetic anisotropy is applied to the thin ribbons in the width direction, so that the characteristics are improved by 40% or more in the induced electromotive force value.

EXAMPLE 14

Figure 29:
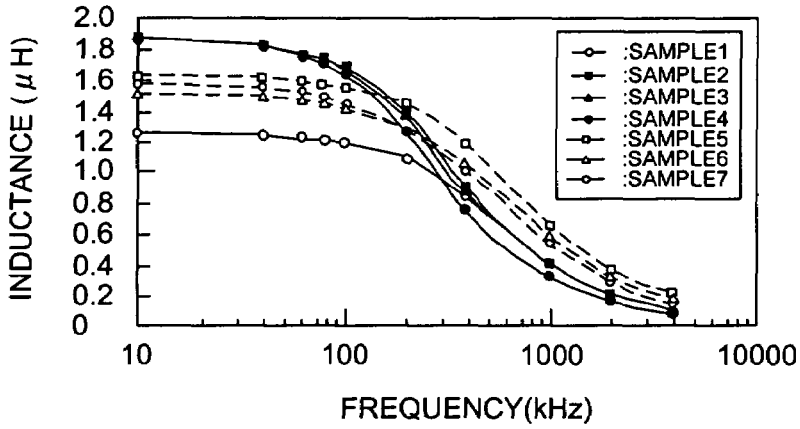
FIG. 29 is a diagram showing a relationship between inductance and frequency in a case where magnetic anisotropy is provided to a thin ribbon in the longitudinal direction, a case where magnetic anisotropy is provided to a thin ribbon in the width direction and a case where magnetic anisotropy is not provided according to Example 14 of the invention.

FIG. 29 shows the results of measuring inductances of an inductor (sample 1) using amorphous magnetic alloy thin ribbons to which magnetic anisotropy was not provided, inductors (samples 2 to 4) using amorphous magnetic alloy thin ribbons to which magnetic anisotropy was provided in a longitudinal direction, and inductors (samples 5 to 7) using amorphous magnetic alloy thin ribbons to which magnetic anisotropy was provided in a width direction, with their frequencies changed. The heat treatment was performed under conditions at 190° C. for 180 min by applying a magnetic field of 1000 A/m.

It is apparent from FIG. 29 that the inductor using the amorphous magnetic alloy thin ribbon to which magnetic anisotropy was provided in the longitudinal direction of the thin ribbons was poor in inductance in a high frequency range in comparison with the inductor to which magnetic anisotropy was provided in the width direction of the thin ribbons but had inductance improved in a low frequency range (200 kHz or less). Especially, it is seen that the improvement of the inductance in a frequency range of 100 kHz or less is conspicuous, and the inductor using the amorphous magnetic alloy thin ribbons to which the magnetic anisotropy is provided in the longitudinal direction of the thin ribbon is preferably used in a frequency range of 100 kHz or less.

EXAMPLE 15

Forty-three Co base amorphous magnetic alloy thin ribbons having a length of 12 mm, a width of 2 mm and a thickness of 19 μm were stacked. The multilayer body had a thickness of 0.83 mm. A heat-bonding line having a diameter of 0.07 mm was wound by 1440 turns around the multilayer body of the Co base amorphous magnetic alloy thin ribbons and heat-bonded to produce a coil. The coil's winding width was 12 mm. Besides, a Co base amorphous magnetic alloy thin ribbon (thickness of 19 μm) having a size of 4.5 mm by 3 mm was adhered to both ends of the multilayer body of the Co base amorphous magnetic alloy thin ribbons. The obtained inductor had a length of 12.1 and a thickness of 3.1 mm. And, a minimum distance between the Co base amorphous magnetic alloy thin ribbon and the coil was 0 mm. The inductor was subjected to characteristic evaluation described later.

EXAMPLE 16

Forty-three Co base amorphous magnetic alloy thin ribbons having a length of 12 mm, a width of 2 mm and a thickness of 19 μm were stacked. The multilayer body had a thickness of 0.83 mm. The multilayer body of the Co base amorphous magnetic alloy thin ribbons was disposed within a liquid crystal resin insulating bobbin. Then, a heat-bonding wire having a diameter of 0.07 mm was wound by 1440 turns around the insulating bobbin and heat-bonded to produce a coil. The coil's winding width was determined to be 12 mm. Besides, a Co based amorphous magnetic alloy thin ribbon (thickness of 19 μm) having a size of 4.5 mm by 3 mm was adhered to both ends of the core. The obtained inductor had a length of 12.8 mm and a thickness of 4.3 mm. The minimum distance between the Co base amorphous magnetic alloy thin ribbons and the coil was 0.3 mm. The inductor was subjected to the characteristic evaluation described later.

EXAMPLE 17

Thirty Co base amorphous magnetic alloy thin ribbons having a length of 30 mm, a width of 0.8 m and a thickness of 19 μm were stacked. The multilayer body had a thickness of 0.58 mm. The multilayer body of the Co based amorphous magnetic alloy thin ribbons was disposed within a heat shrinkable tube having a diameter of 1.2 mm and a thickness of 50 μm. Then, a heat-bonding wire having a diameter of 0.07 mm was wound by 1440 turns around the heat shrinkable tube and heat-bonded to form a coil. The coil's winding width was determined to be 24 mm. Besides, a Co based amorphous magnetic alloy thin ribbon (thickness of 19 μm) having a size of 2 mm by 2 mm was adhered to both ends of the core. The obtained inductor had a length of 30.1 mm and a thickness of 2 mm. The minimum distance between the Co base amorphous magnetic alloy thin ribbon and the coil was 0.05 mm. The inductor was subjected to the characteristic evaluation described later.

EXAMPLE 18

A heat-bonding wire having a diameter of 0.06 mm was wound by 1440 turns and heat-bonded to form an air core coil. A T-shaped Co base amorphous magnetic alloy thin ribbon was inserted from both sides of the air core coil to produce an inductor. The Co base amorphous magnetic alloy thin ribbon has a shape of 11×2 mm, and a thickness of 19 μm. The stacked number of the Co base amorphous magnetic alloy thin ribbons was 43 and the multilayer body had a thickness of 0.83 mm. The obtained inductor had a length of 12.2 mm and a thickness of 3.2 mm. And, the minimum distance between the Co base amorphous magnetic alloy thin ribbons and the coil was 0 mm. The inductor was subjected to the characteristic evaluation described later.

EXAMPLE 19

An inductor was produced in the same manner as in Example 18 except that the center portion of the inductor was pressed to expand both sides of the Co base amorphous magnetic alloy thin ribbons in Example 18. The obtained inductor was subjected to the characteristic evaluation described later.

COMPARATIVE EXAMPLE 3

An inductor was produced in the same manner as in Example 15 except that ferrite having the same shape (rectangular parallelepiped/no magnetic alloy thin ribbon at both ends) as that of the multilayer body of the Co base amorphous magnetic alloy thin ribbons used as the core in Example 15 was used as the core. This inductor was subjected to the characteristic evaluation described later.

The individual inductors of Examples 15 to 19 and the inductor of Comparative Example 3 were measured and evaluated for the characteristics as follows. First, inductance L and Q value of the individual inductors at 40 kHz were measured. The measured results are shown in Table 7. And, their characteristics as antenna were evaluated as follows. First, capacitors corresponding to individual values L were prepared so to oscillate at 40 kHz and connected to an IC (SM9501A manufactured by NPC). Time information was received five times in total with date and time changed to evaluate whether or not time information could be obtained. The evaluated results are shown in Table 8. Besides, the individual inductors of Examples 15 to 19 and Comparative Example 3 were free-fallen from a height of 10 m to a wood floor, the number of times of falling and value L•Q were checked for a change rate. The measured results are shown in Table 9.

TABLE 7

| | $L_{40}$(mH) | $Q_{40}$ | L · Q | Length Y(mm) | L · Q/Y |
|---|---|---|---|---|---|
| E15 | 22.34 | 64.8 | 1448 | 12.1 | 120 |
| E16 | 20.01 | 58.1 | 1163 | 13.0 | 89 |
| E17 | 38.40 | 75.2 | 2888 | 30.1 | 96 |
| E18 | 26.42 | 57.4 | 1517 | 12.2 | 124 |
| E19 | 26.88 | 61.9 | 1664 | 12.1 | 138 |
| CE3 | 17.44 | 45.1 | 787 | 12.0 | 66 |

E = Example;
CE = Comparative Example

TABLE 8

| | Number of times of successful reception |
|---|---|
| Example 15 | 5/5 |
| Example 16 | 4/5 |
| Example 17 | 5/5 |
| Example 18 | 4/5 |
| Example 19 | 5/5 |
| Comparative Example 3 | 1/5 |

TABLE 9

| Number of | L · Q value | | Change rate of L · Q value | |
|---|---|---|---|---|
| times of falling | Example 15 | Comparative Example 3 | Example 15 | Comparative Example 3 |
| 1 | 1448 | 787 | 0.00% | 0.00% |
| 2 | 1448 | 211 | 0.00% | −73.19% |
| 3 | 1445 | 3.6 | −0.21% | −99.54% |
| 4 | 1445 | 3.6 | −0.21% | −99.54% |

It is apparent from Table 7 and Table 8 that the inductors of the examples excel in receiving performance because they have high value L•Q per unit length. Especially, where the value L•Q per unit length is 80 or more, the receiving performance can be improved. In a case where the magnetic alloy thin ribbon at both ends of the core in Example 17 is omitted, it is necessary to make the core long in order to obtain the same performance. And, it is seen from Table 9 that the inductor of the example excels in drop impact resistance. The inductor of Comparative Example 3 had the core cracked by the first drop test and broken by the third drop test, resulting in lowering the characteristics to the air core level.

EXAMPLE 20

Thirty Co base amorphous magnetic alloy thin ribbons having a length of 30 mm, a width of 0.8 mm and a thickness of 16 μm were prepared. Ink of an oily pigment was coated on both surfaces of the Co base amorphous magnetic alloy thin ribbons, and they were dried at room temperature and stacked. The oily pigment functions as an insulating interlayer. The multilayer body of the Co base amorphous magnetic alloy thin ribbons was disposed within a heat shrinkable tube having a diameter of 1.4 mm, and the tube was heat-shrunk to fix the magnetic alloy thin ribbons. Then, a heat-bonding wire having a diameter of 0.07 mm was wound by 1440 turns around the heat shrinkable tube and heat-bonded to form a coil. The obtained inductor was subjected to the characteristic evaluation described later.

REFERENCE EXAMPLE 3

An inductor was produced in the same manner as in Example 20 except that a polyimide resin was used for the insulating interlayer in Example 20. The polyimide resin as the insulating interlayer was subjected to the heat treatment at 400° C. The obtained inductor was subjected to the characteristic evaluation described later.

REFERENCE EXAMPLE 4

An inductor was produced in the same manner as in Example 20 except that an Fe base amorphous magnetic alloy thin ribbon was used in Example 20. The inductor was subjected to the characteristic evaluation.

The inductor of Example 20 and the individual inductors of Reference Examples 3 and 4 were measured and evaluated for the characteristics as follows. First, inductance L and Q value of the individual inductors at 40 kHz were measured. The measured results are shown in Table 10. And, their characteristics as antenna were evaluated as follows. First, a winding wire was wound around an acrylic plate of 390×295 mm by 11 turns as an antenna for transmitting to prepare a loop antenna. A sine wave of 7 $V_{p-p}$ was input to the ends of the winding wire. A receiving antenna had a resonant capacitor of 800 pF connected in parallel to the individual inductors, and output voltage $V_0$ at the time of resonance was measured through an amplifier of 40 dB. Besides, resonance sharpness Qa ($Qa=f_0/(f_1-f_2)$ ($f_0$: resonance frequency, $f_1$, $f_2$: frequency when output voltage at the time of resonance dropped by 3 dB)) was measured. The measured results are shown in Table 11.

TABLE 10

| | $L_{40}$(mH) | $Q_{40}$ |
|---|---|---|
| Example 20 | 22 | 66 |
| Reference Example 3 | 23.7 | 51 |
| Reference Example 4 | 5.0 | 10 |

TABLE 11

| | $F_0$(kHz) | $V_0$(mV) | Qa |
|---|---|---|---|
| Example 20 | 39.065 | 760 | 215 |
| Reference Example 3 | 37.997 | 480 | 126 |
| Reference Example 4 | 79.855 | 25 | 21 |

The inductor of Example 20 having the insulating interlayer cold-formed excels in Q value. Meanwhile, the inductors of Reference Examples 3 and 4 had the Q value lowered in comparison with Example 20. Therefore, the output sensitivity V0 of the antenna and the resonance sharpness Qa became low.

EXAMPLE 21

A Co base amorphous magnetic alloy thin ribbon having a length of 30 mm, a width of 0.8 mm and a thickness of 16 μm was subjected to a heat treatment at 430° C. for 30 min, and a heat treatment in a magnetic field was performed at 190° C. for 180 min while applying a DC magnetic field of 1000 A/m. The direction of applying the magnetic field was varied so that an angle with respect to the longitudinal direction (normal line direction of coil wound surface) of the Co base amorphous magnetic alloy thin ribbon is in a range of 45 to 90°. The Co base amorphous magnetic alloy thin ribbon was subjected to interlayer insulation, and 30 of it were stacked to form a core. A winding wire (winding wire length: 31 mm, wire diameter: 0.07 mm) was wound by 1140 turns around the core with the longitudinal direction of the thin ribbons determined as the winding surface direction to produce an inductor.

Figure 30:
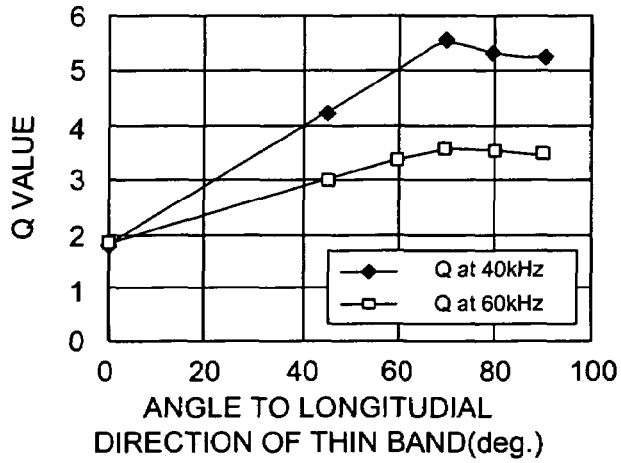
FIG. 30 is a diagram showing a relationship between a direction (angle to a longitudinal direction of the thin ribbon) and Q value of induced magnetic anisotropy applied to the amorphous magnetic alloy thin ribbon according to Example 21 of the invention.
Figure 31:
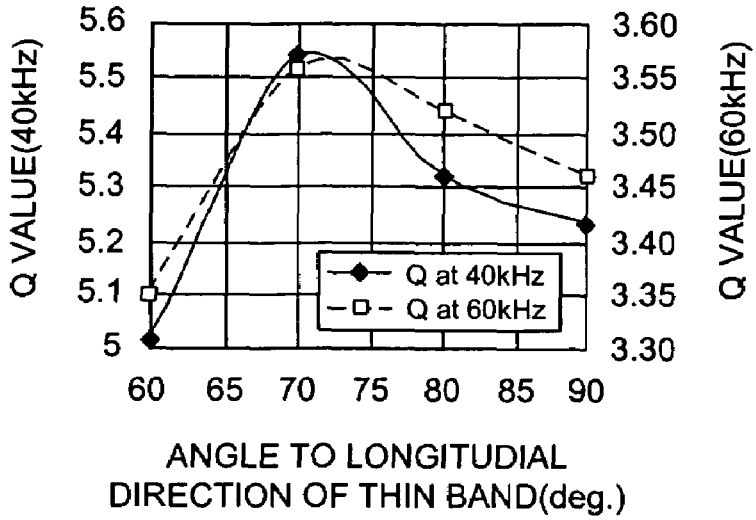
FIG. 31 is a diagram showing a relationship between a direction (angle to a longitudinal direction of the thin ribbon) and Q value of the induced magnetic anisotropy applied to the amorphous magnetic alloy thin ribbon according to Example 21 of the invention.

The individual inductors were measured for Q value. The measured results are shown in FIG. 30 and FIG. 31. And, the characteristics as antenna were evaluated as follows. First, the individual inductors were connected to a capacitor for adjustment of the number of resonances and an IC (SM9501A manufactured by NPC). Time information was received five times in total with date and time changed to evaluate whether or not time information could be obtained. The evaluated results are shown in Table 12.

TABLE 12

| θ (deg) | Number of times of successful reception |
|---|---|
| 45 | 0/5 |
| 60 | 1/5 |
| 65 | 3/5 |
| 70 | 4/5 |
| 80 | 5/5 |
| 85 | 4/5 |
| 90 | 3/5 |

It is apparent from FIG. 30 and FIG. 31 that good Q value can be obtained by determining a direction of providing induced magnetic anisotropy to 70° or more with respect to the longitudinal direction of the thin ribbons. Besides, it is seen that a particularly good antenna characteristic can be obtained when an amorphous magnetic alloy thin ribbon of which a direction of providing an induced magnetic anisotropy is in a range of 70 to 85° with respect to a longitudinal direction of the thin ribbons is used.

EXAMPLE 22

Figure 32:
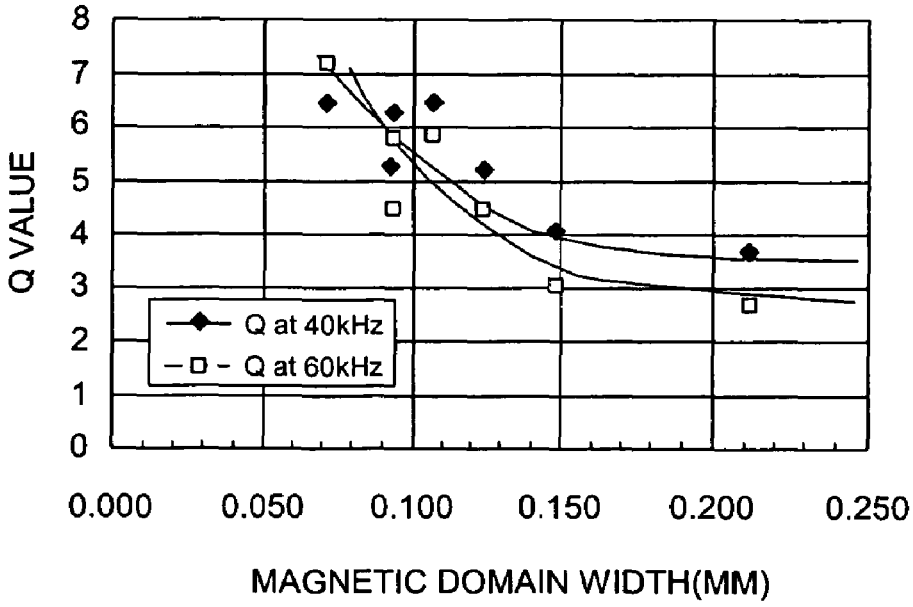
FIG. 32 is a diagram showing a relationship between a magnetic domain width and Q value of the amorphous magnetic alloy thin ribbon according to Example 22 of the invention.

A Co base amorphous magnetic alloy thin ribbon having a thickness of 16 μm was prepared, and it was subjected to a heat treatment under various conditions to provide it with induced magnetic anisotropy in an in-plane width direction. The heat treatment was performed in the atmosphere, and the heat treatment in a magnetic field was performed in a DC magnetic field of 1000 A/m. The magnetic domain width of the Co base amorphous magnetic alloy thin ribbon is shown in FIG. 32 and Table 13. The magnetic domain width is a reciprocal number of the number of magnetic domains per unit length. Thirty of the Co base amorphous magnetic alloy thin ribbons (a length of 30 mm and a width of 0.8 mm) were stacked to form a core, and a winding wire (winding wire length: 31 mm, wire diameter: 0.07 mm) was wound by 1140 turns around the thin ribbons with their longitudinal direction determined as a vertical direction in a winding surface to produce individual inductors. Value Q and antenna characteristics of the individual inductors were measured in the same manner as in Example 21. The measured results are shown in FIG. 32 and Table 13.

In Table 13, sample 1 was a Co base amorphous magnetic alloy thin ribbon which was slit to a width of 0.8 mm, undergone a heat treatment in an nonmagnetic field at 380° C. for 30 min, and undergone a heat treatment in a vertical magnetic field at 230° C. for 30 min. Sample 2 is the same as sample 1 except that the conditions of the heat treatment in a nonmagnetic field were changed to 400° C. and 30 min. Sample 3 is the same as sample 1 except that the conditions of the heat treatment in a nonmagnetic field were changed to 430° C. and 60 min. Sample 4 is a Co base amorphous magnetic alloy thin ribbon which was slit to a width of 0.8 mm, undergone a heat treatment in a nonmagnetic field at 430° C. for 60 min, and further undergone a heat treatment in a vertical magnetic field at 190° C. for 240 min. Sample 5 is the same as sample 4 except that the conditions of the heat treatment in a magnetic field were changed to 230° C. and 240 min. Sample 6 is a Co base amorphous magnetic alloy thin ribbon having a width of 50 mm which was undergone a heat treatment in a nonmagnetic field at 430° C. for 30 min, further undergone a heat treatment in a vertical magnetic field at 230° C. for 240 min, and slit to a width of 0.8 mm.

TABLE 13

| Sample | Magnetic domain width (mm) | Number of times of successful reception |
|---|---|---|
| 1 | 0.211 | 0/5 |
| 2 | 0.148 | 0/5 |
| 3 | 0.123 | 2/5 |
| 4 | 0.106 | 4/5 |
| 5 | 0.092 | 5/5 |
| 6 | 0.070 | 5/5 |

It is apparent from FIG. 32 and Table 13 that good Q value can be obtained by determining the magnetic domain width of the amorphous magnetic alloy thin ribbon to 0.106 mm or less. Besides, it is seen that especially good antenna characteristics can be obtained when an amorphous magnetic alloy thin ribbon having a magnetic domain width of 0.106 mm or less is used.

EXAMPLE 23

Co base amorphous magnetic alloy thin ribbons each having a thickness of 16 μm were stacked up to a thickness of 0.6 mm and housed into an insulating tube to produce a core. A winding wire was wound around individual cores to produce inductors. The obtained inductors each were disposed as an antenna element within a wristwatch type radio-controlled timepiece, and their characteristics were evaluated. The inductor characteristics were measured for inductance L and Q value at 40 kHz. Time information was received five times in total with date and time changed to evaluate whether or not time information could be obtained. The measured and evaluated results are shown in Table 14.

In Table 14, sample 1 was prepared by preparing two inductors (winding wire: 825 turns) by using a Co base amorphous magnetic alloy thin ribbon having a length of 10 mm and a width of 1.2 mm, disposing them on upper and lower portions of a timepiece body with a gap of 15.5 mm therebetween, and connecting the two inductors in series. Sample 2 was prepared by preparing one inductor (winding wire: 1650 turns) by using a Co base amorphous magnetic alloy thin ribbon having a length of 20 mm and a width of 1.2 mm, and disposing it on a belt of a wristwatch. It was connected to the timepiece body with a flexible substrate. Sample 3 was prepared by preparing one inductor (winding wire: 1650 turns) by using a Co base amorphous magnetic alloy thin ribbon having a length of 20 mm and a width of 1.2 mm, and disposing it at an upper part of a timepiece body. Sample 4 was prepared by preparing two inductors (winding wire: 825 turns) by using a Co base amorphous magnetic alloy thin ribbon having a length of 10 mm and a width of 1.2 mm, and disposing them at upper and lower portions of a timepiece body with a gap of 1 mm therebetween.

TABLE 14

| Sample | $L_{40}$(mH) | $Q_{40}$ | Mountable timepiece diameter | Number of times of successful reception |
|---|---|---|---|---|
| 1 | 19.86 (*9.93) | 90 (*45) | 19 mm | 5/5 |
| 2 | 20.02 | 98 | — | 5/5 |
| 3 | 20.02 | 98 | 33 mm | 5/5 |
| 4 | 8.71 | 41 | 19 mm | 0/5 |

*value of one inductor

It is apparent from Table 14 that the wristwatch type radio-controlled timepiece (using two inductors connected in series) of sample 1 is provided with the same performance as that of sample 3 (using a long inductor), and the miniaturization of the wristwatch type radio-controlled timepiece is assisted. The wristwatch type radio-controlled timepiece of sample 4 which has two inductors disposed with a gap of 1 mm therebetween has a decrease of Q value because the two inductors interfere with each other, and the receiving characteristics are lowered.

INDUSTRIAL APPLICABILITY

According to the inductance element of the invention, good characteristics can be obtained stably even if miniaturization and shortening were made. And, even when the inductive element is used in a bent state, the characteristics can be suppressed from lowering. Therefore, the inductance element can be used effectively as a data carrier part and an antenna element of a radio-controlled timepiece which is formed to be, for example, thin, small and short. According to a method for manufacturing the inductance element of the invention, a small inductance element having good inductance can be produced with good reproducibility. Thus, a small and high performance inductance element can be provided.

What is claimed is:

1. An inductance element for an antenna, comprising:

a core provided with a multilayer body which has plural magnetic alloy thin ribbons stacked; and a coil disposed around the core, wherein the magnetic alloy thin ribbons are determined to have a magnetic domain width m of 0.106 mm or less with respect to their longitudinal directions, wherein the magnetic alloy thin ribbons are Co base alloy thin ribbons.

2. The inductance element according to claim 1, wherein the magnetic domain width m and a width w of the magnetic alloy thin ribbons satisfies a relationship of $m \leqq 0.106 \times (w/0.8)$ [mm].

3. The inductance element according to claim 1, wherein the magnetic alloy thin ribbons are provided with induced magnetic anisotropy in an in-plane width direction.

4. The inductance element according to claim 1, wherein the magnetic domain width m is 0.092 mm or less.

5. An antenna using the inductance element as claimed in claim 1.

* * * * *